US010273688B2

(12) United States Patent
McManus

(10) Patent No.: US 10,273,688 B2
(45) **Date of Patent: *Apr. 30, 2019**

(54) TILE AND SUPPORT STRUCTURE

(71) Applicant: MBRICO, LLC, Bettendorf, IA (US)

(72) Inventor: Mark A. McManus, Bettendorf, IA (US)

(73) Assignee: MBRICO, LLC, Bettendorf, IA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/947,774

(22) Filed: Apr. 6, 2018

(65) Prior Publication Data

US 2018/0223528 A1 Aug. 9, 2018

Related U.S. Application Data

(63) Continuation of application No. 15/637,307, filed on Jun. 29, 2017, now Pat. No. 9,938,715, which is a (Continued)

(51) Int. Cl.
*E04B 5/02* (2006.01)
*E04B 5/10* (2006.01)
(Continued)

(52) U.S. Cl.
CPC ..... *E04B 5/023* (2013.01); *E04B 1/003* (2013.01); *E04B 5/02* (2013.01); *E04B 5/10* (2013.01);
(Continued)

(58) Field of Classification Search
CPC . E04B 1/003; E04B 5/02; E04B 5/023; E04B 5/10; E04B 5/12; E04D 1/16;
(Continued)

(56) References Cited

U.S. PATENT DOCUMENTS

RE16,416 E * 9/1926 Whittaker ..... E04B 5/12 52/126.5
3,027,140 A 3/1962 Holzbach
(Continued)

FOREIGN PATENT DOCUMENTS

DE 202013102695 U1 7/2013
EP 2669444 A2 12/2013
(Continued)

OTHER PUBLICATIONS

PCT/US2016/058511 International Search Report and Written Opinion, dated Apr. 13, 2017.

*Primary Examiner* — Patrick J Maestri
*Assistant Examiner* — Joseph J. Sadlon
(74) *Attorney, Agent, or Firm* — Hamilton IP Law, PC; Jay R. Hamilton; Charles A. Damschen

(57) ABSTRACT

An illustrative embodiment of a tile and support structure may include a plurality of tiles, which may be generally rectangular in shape, engaged with one or more support structures. The tile may be formed with four edges, wherein two opposing edges may be formed with grooves therein and the other two opposing edges may be formed with protrusions thereon. The support structure may be formed with a generally vertical spine having two rails extending outward from a distal end thereof. The support structure may also include two generally horizontally extending flanges, which may be formed with a trough therein. The trough may include a plurality of apertures formed therein. One side of the trough may be defined by a lip.

20 Claims, 18 Drawing Sheets

Related U.S. Application Data continuation of application No. 14/841,211, filed on Aug. 31, 2015, now Pat. No. 9,702,145, which is a continuation of application No. 14/524,431, filed on Oct. 27, 2014, now Pat. No. 9,151,063.

(60) Provisional application No. 61/895,930, filed on Oct. 25, 2013.

(51) Int. Cl.

| | |
|---|---|
| ***E04F 15/08*** | (2006.01) |
| ***E04F 15/02*** | (2006.01) |
| ***E04D 1/16*** | (2006.01) |
| ***E04B 1/00*** | (2006.01) |
| ***E04D 1/34*** | (2006.01) |
| *E04B 5/12* | (2006.01) |

(52) U.S. Cl.

CPC ..... *E04D 1/16* (2013.01); *E04D 1/34* (2013.01); *E04F 15/02005* (2013.01); *E04F 15/02038* (2013.01); *E04F 15/02044* (2013.01); *E04F 15/082* (2013.01); *E04B 5/12* (2013.01); *E04D 2001/3447* (2013.01); *E04F 2015/0205* (2013.01); *E04F 2015/02088* (2013.01)

(58) Field of Classification Search

CPC ..... E04D 1/34; E04D 2001/3447; E04F 15/02005; E04F 15/02038; E04F 15/02044; E04F 15/082; E04F 2015/0205; E04F 2015/02088

USPC ..... 52/483.1, 586.1

See application file for complete search history.

(56) References Cited

U.S. PATENT DOCUMENTS

| | | | | |
|---|---|---|---|---|
| 3,065,506 | A | 11/1962 | Tremer | |
| 3,553,919 | A | 1/1971 | Omholt | |
| 3,645,054 | A | 2/1972 | Olvera | |
| 3,909,145 | A | 9/1975 | Ayer et al. | |
| 4,067,161 | A | 1/1978 | Rensch | |
| 4,395,858 | A | 8/1983 | Gwyther | |
| 4,408,427 | A | 10/1983 | Zilch | |
| 4,546,580 | A | 10/1985 | Ueno et al. | |
| 4,599,842 | A * | 7/1986 | Counihan | E04F 13/0803 411/424 |
| 4,648,231 | A | 3/1987 | Laroche | |
| 4,716,704 | A | 1/1988 | Murr | |
| 4,835,924 | A | 6/1989 | Blacklin et al. | |
| 4,895,335 | A | 1/1990 | Oliver | |
| 4,911,971 | A | 3/1990 | McCue et al. | |
| D320,685 | S | 10/1991 | Huang | |
| 5,083,410 | A | 1/1992 | Watson | |
| 5,111,627 | A * | 5/1992 | Brown | E04F 15/024 52/126.5 |
| 5,333,423 | A | 8/1994 | Propst | |
| 5,409,192 | A | 4/1995 | Oliver | |
| 5,483,776 | A | 1/1996 | Poppe | |
| 5,497,593 | A * | 3/1996 | Riesberg | E04B 5/12 403/232.1 |
| 5,501,754 | A | 3/1996 | Hiraguri | |
| 5,553,427 | A * | 9/1996 | Andres | E04B 5/026 114/266 |
| 5,606,840 | A | 3/1997 | Hase | |
| 5,623,803 | A | 4/1997 | Willis | |
| 5,765,329 | A | 6/1998 | Huang | |
| 5,775,048 | A | 7/1998 | Orchard | |
| 5,813,180 | A | 9/1998 | Whitney et al. | |
| 5,850,720 | A | 12/1998 | Willis | |
| 5,906,082 | A | 5/1999 | Counihan | |
| 5,992,109 | A | 11/1999 | Jonker | |
| 5,997,209 | A | 12/1999 | Sachs | |
| 6,189,289 | B1 | 2/2001 | Quaglia et al. | |
| 6,363,674 | B1 | 4/2002 | Carver | |
| 6,430,883 | B1 | 8/2002 | Paz et al. | |
| 6,502,791 | B2 | 1/2003 | Parker | |
| D470,039 | S | 2/2003 | Pelc | |
| 6,550,206 | B2 | 4/2003 | Lee | |
| 6,901,715 | B2 * | 6/2005 | Brown | E04B 5/12 52/289 |
| D522,147 | S | 5/2006 | Morton et al. | |
| 7,047,697 | B1 * | 5/2006 | Heath | E04F 15/10 52/177 |
| 7,621,089 | B2 | 11/2009 | Potter | |
| 7,818,925 | B2 | 10/2010 | Benedict | |
| 7,958,688 | B2 * | 6/2011 | Vilar Llop | E04F 13/0835 52/582.2 |
| 8,002,943 | B2 | 8/2011 | Brown et al. | |
| 8,006,458 | B1 | 8/2011 | Olofsson | |
| 8,056,303 | B2 | 11/2011 | Frobosilo | |
| 8,177,385 | B2 * | 5/2012 | Porciatti | E04B 9/006 362/147 |
| 8,256,172 | B2 | 9/2012 | Benson | |
| 8,381,461 | B2 | 2/2013 | Repasky | |
| 8,516,762 | B1 | 8/2013 | Jendusa | |
| D704,864 | S | 5/2014 | Chang | |
| 8,869,481 | B2 | 10/2014 | Dzigava | |
| 8,925,263 | B2 | 1/2015 | Haddock et al. | |
| 8,984,818 | B2 | 3/2015 | McPheeters et al. | |
| D728,185 | S | 4/2015 | Pelc et al. | |
| 9,151,063 | B2 | 10/2015 | McManus | |
| 9,181,715 | B2 * | 11/2015 | Orchard | E04F 15/02044 |
| 9,314,936 | B2 * | 4/2016 | Pervan | B26D 1/14 |
| 2002/0078638 | A1 | 6/2002 | Huang | |
| 2003/0046895 | A1 | 3/2003 | Haffner et al. | |
| 2003/0074853 | A1 | 4/2003 | Potter | |
| 2003/0188500 | A1 | 10/2003 | Voegele | |
| 2004/0244325 | A1 | 12/2004 | Nelson | |
| 2006/0059822 | A1 * | 3/2006 | Guffey | E04F 15/02 52/480 |
| 2007/0113511 | A1 | 5/2007 | Greiner | |
| 2012/0047834 | A1 | 3/2012 | Stal et al. | |
| 2012/0151867 | A1 | 6/2012 | Smith et al. | |
| 2013/0283710 | A1 | 10/2013 | Laurin et al. | |
| 2014/0007525 | A1 | 1/2014 | Wright | |
| 2015/0275500 | A1 | 10/2015 | Dalla et al. | |

FOREIGN PATENT DOCUMENTS

| | | | |
|---|---|---|---|
| FR | 2761095 | A1 | 9/1998 |
| JP | 04238954 | A * | 8/1992 |
| JP | 2008240417 | A | 10/2008 |
| JP | 2010144372 | A | 7/2010 |
| WO | 2012060488 | A1 | 5/2012 |

* cited by examiner

TILE AND SUPPORT STRUCTURE

CROSS REFERENCE TO RELATED APPLICATIONS

The present application is a continuation of and claims priority from U.S. patent application Ser. No. 15/637,307 filed on Jun. 29, 2017, which was a continuation of U.S. patent application Ser. No. 14/841,211 (now U.S. Pat. No. 9,702,145) filed on Aug. 31, 2015, which was a continuation of U.S. patent application Ser. No. 14/524,431 filed on Oct. 27, 2014 (now U.S. Pat. No. 9,151,063), which application claimed priority from provisional U.S. Pat. App. No. 61/895,930 filed on Oct. 25, 2013, all of which are incorporated by reference herein in their entireties.

FIELD OF THE INVENTION

The present disclosure relates to a tile and tile support structure allowing use of placement of porcelain tiles for outdoor deck systems.

STATEMENT REGARDING FEDERALLY SPONSORED RESEARCH OR DEVELOPMENT

No federal funds were used to develop or create the invention disclosed and described in the patent application.

REFERENCE TO SEQUENCE LISTING, A TABLE, OR A COMPUTER PROGRAM LISTING COMPACT DISK APPENDIX

Not Applicable.

AUTHORIZATION PURSUANT TO 37 C.F.R. § 1.171 (C)

A portion of the disclosure of this patent document may contain material that is subject to copyright and trademark protection. The copyright owner has no objection to the facsimile reproduction by anyone of the patent document or the patent disclosure, as it appears in the Patent and Trademark Office patent file or records, but otherwise reserves all copyrights whatsoever.

BACKGROUND OF THE INVENTION

Not Applicable.

DESCRIPTION OF RELATED ART INCLUDING INFORMATION DISCLOSED UNDER 37 CFR 1.97 AND 1.98

Not Applicable.

BRIEF SUMMARY OF THE INVENTION

Not Applicable.

BRIEF DESCRIPTION OF FIGURES

In order that the advantages of the invention will be readily understood, a more particular description of the invention briefly described above will be rendered by reference to specific embodiments illustrated in the appended drawings. Understanding that these drawings depict only typical embodiments of the invention and are not therefore to be considered limited of its scope, the invention will be described and explained with additional specificity and detail through the use of the accompanying drawings.

DETAILED DESCRIPTION - LISTING OF ELEMENTS

| Element Description | Element Number |
|---|---|
| Tile & support structure | 10 |
| Deck | 12 |
| Joist | 14 |
| Fastener | 16 |
| Substrate | 18 |
| Tile | 20 |
| Face | 22 |
| Edge | 24 |
| Groove | 24a |
| Protrusion | 24b |
| Clearance | 25 |
| Support structure | 30 |
| Edge support structure | 30a |

-continued

| DETAILED DESCRIPTION - LISTING OF ELEMENTS | |
|---|---|
| Element Description | Element Number |
| Base | 31 |
| Flange | 32 |
| Trough | 32a |
| Aperture | 32b |
| Lip | 33 |
| Spine | 34 |
| Tip | 34a |
| Rail | 36 |

DETAILED DESCRIPTION OF INVENTION

Before the various embodiments of the present invention are explained in detail, it is to be understood that the invention is not limited in its application to the details of construction and the arrangements of components set forth in the following description. The invention is capable of other embodiments and of being practiced or of being carried out in various ways. Also, it is to be understood that phraseology and terminology used herein with reference to device or element orientation (such as, for example, terms like "front", "back", "up", "down", "top", "bottom", and the like) are only used to simplify description of the present invention, and do not alone indicate or imply that the device or element referred to must have a particular orientation. In addition, terms such as "first", "second", and "third" are used herein and in the appended claims for purposes of description and are not intended to indicate or imply relative importance or significance. Further, although some figures included herewith show various dimensions of some features of certain illustrative embodiments of the present invention, such dimensions are for illustrative purposes only and in no way limits the scope of the present disclosure.

The following detailed description is of the best currently contemplated modes of carrying out illustrative embodiments of the invention. The description is not to be taken in a limiting sense, but is made merely for the purpose of illustrating the general principles of the invention, since the scope of the invention is best defined by the appending claims. Various inventive features are described below herein that can each be used independently of one another or in combination with other features.

Figure 1:
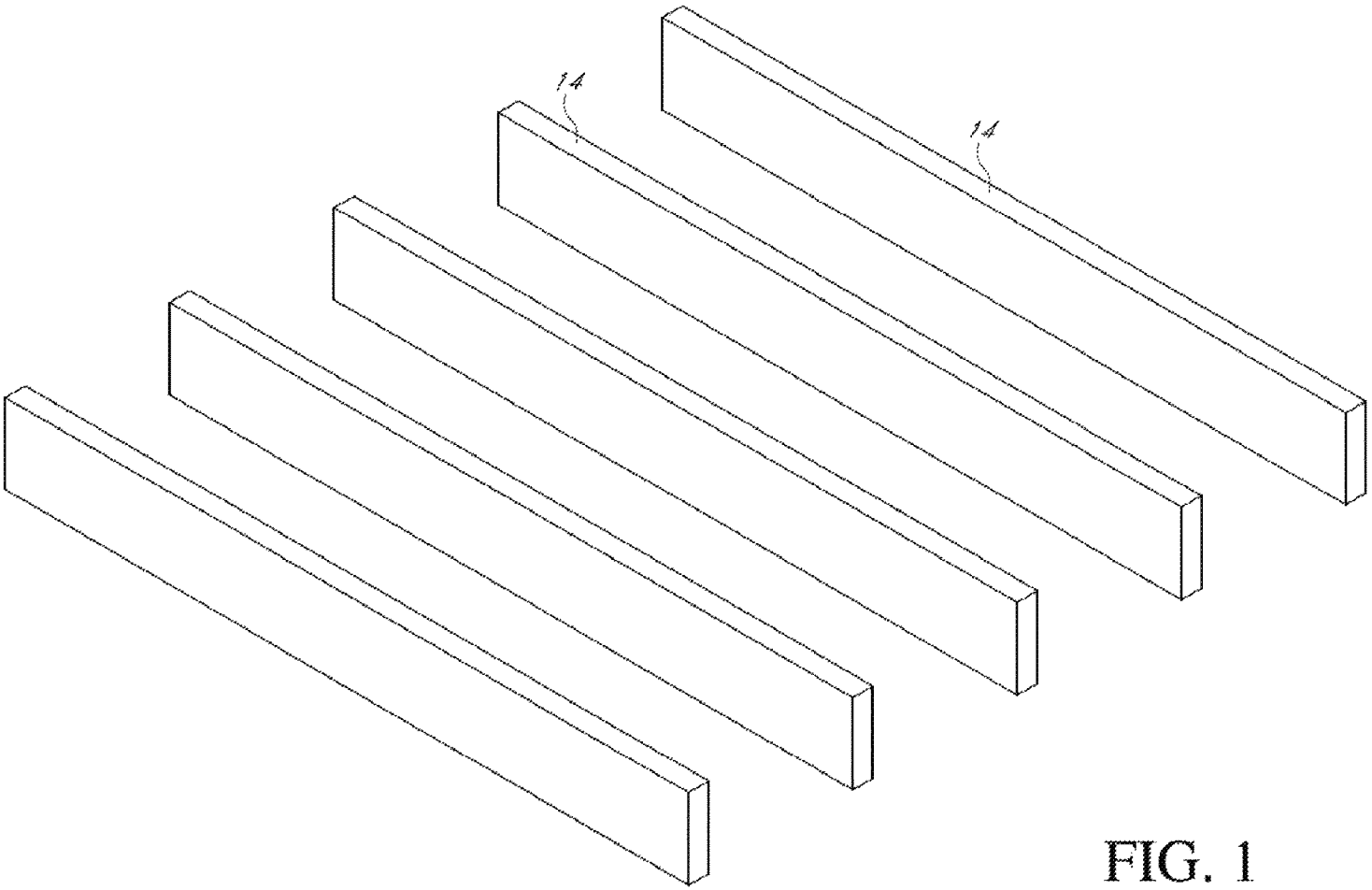
FIG. 1 is a perspective view of one embodiment of a plurality of joists arranged in a typical manner for a building structure.

A group of joists 14 in a typical arrangement is shown in FIG. 1, wherein the joists 14 are oriented parallel with respect to one another about their lengths. It is contemplated that the illustrative embodiments of a tile and support structure 10 as disclosed herein may be adapted for use with such joists 14 and/or arrangements thereof. However, the tile and support structure 10 may be used with other supporting components, and the use of joists 14 is therefore in no way limiting to the scope of the present disclosure.

Figure 2:
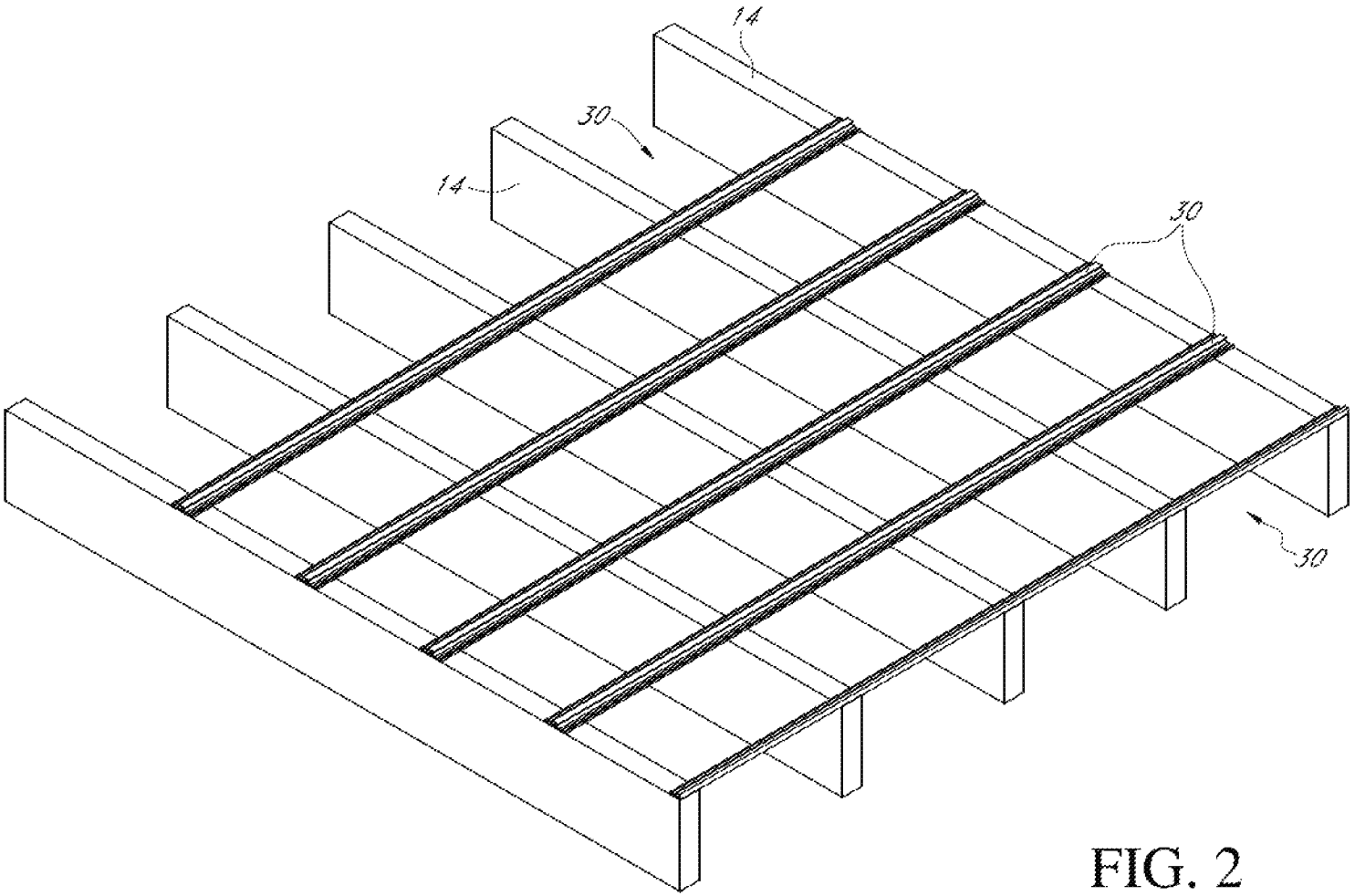
FIG. 2 is a perspective view of the joists from FIG. 1 having a plurality of an illustrative embodiment of support structures engaged with the joists.

As shown in FIG. 2, a plurality of support structures 30 may be engaged with the joists 14 such that the support structures 30 may be oriented parallel with respect to one another with respect to their lengths. It is contemplated that the support structures 30 may be engaged with the top edge of the joists 14 via one or more fasteners 16 in a manner similar to that in which decking material may be engaged with joists 14. In one embodiment, the fasteners 16 may be configured as wood screws. However, the specific method and/or structure used to engage the support structures 30 with the joists 14 in no way limits the scope of the present disclosure. Additionally, the support structures 30 may be oriented such that they are not perpendicular with respect to the joists 14, but such that they support structures 30 are still oriented parallel with respect to one another without limitation.

The support structures 30 may be configured such that they are oriented perpendicular with respect to the joists 14 so that the joists 14 and support structures 30 may form a grid. In certain embodiments it may be advantageous to position a cross lathe (not shown) under each support structure 30. The cross lathe may be configured as a wooden one-by-three inch board, a wooden one-by-four inch board, or any other suitable structure without limitation, including but not limited to plastic and/or polymer strips. The cross lathe and support structure 30 may be engaged with one another and the joists 14 and the relative positions thereof secured via one or more fasteners 16. It is contemplated that such a configuration may be especially useful if there is a reasonable likelihood that the position of the joists 14 and/or other underlying structure might shift over time. Accordingly, the scope of the present disclosure is in no way limited by whether a cross lathe is used. Furthermore, the specific method and/or structure used to engage the cross lathes with the joists 14 and/or support structures 30 in no way limits the scope of the present disclosure.

Figure 3:
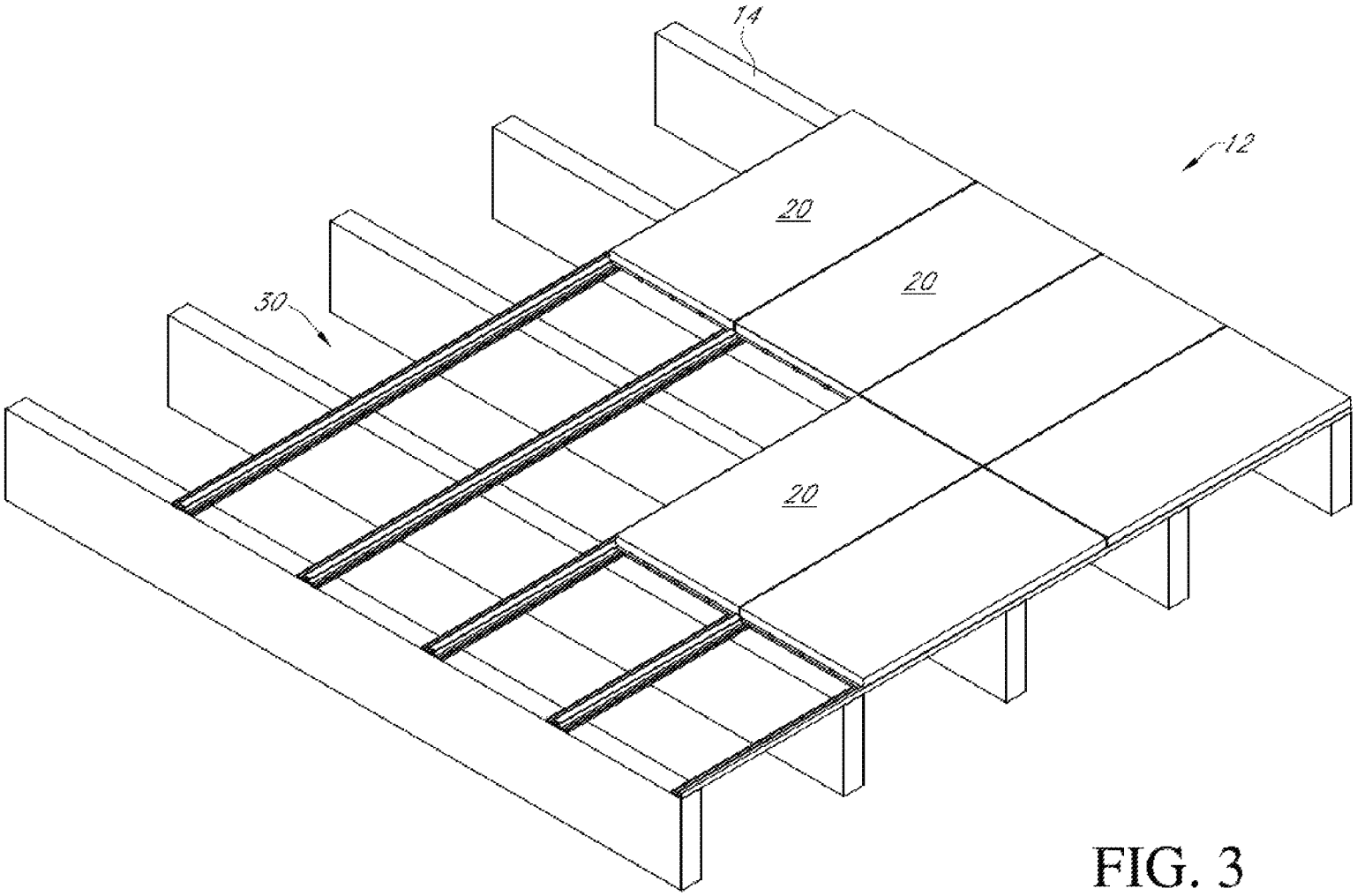
FIG. 3 is a perspective view of the joists and support structures from FIG. 2 wherein a plurality of and illustrative embodiment tiles are engaged with the support structures.
Figure 4:
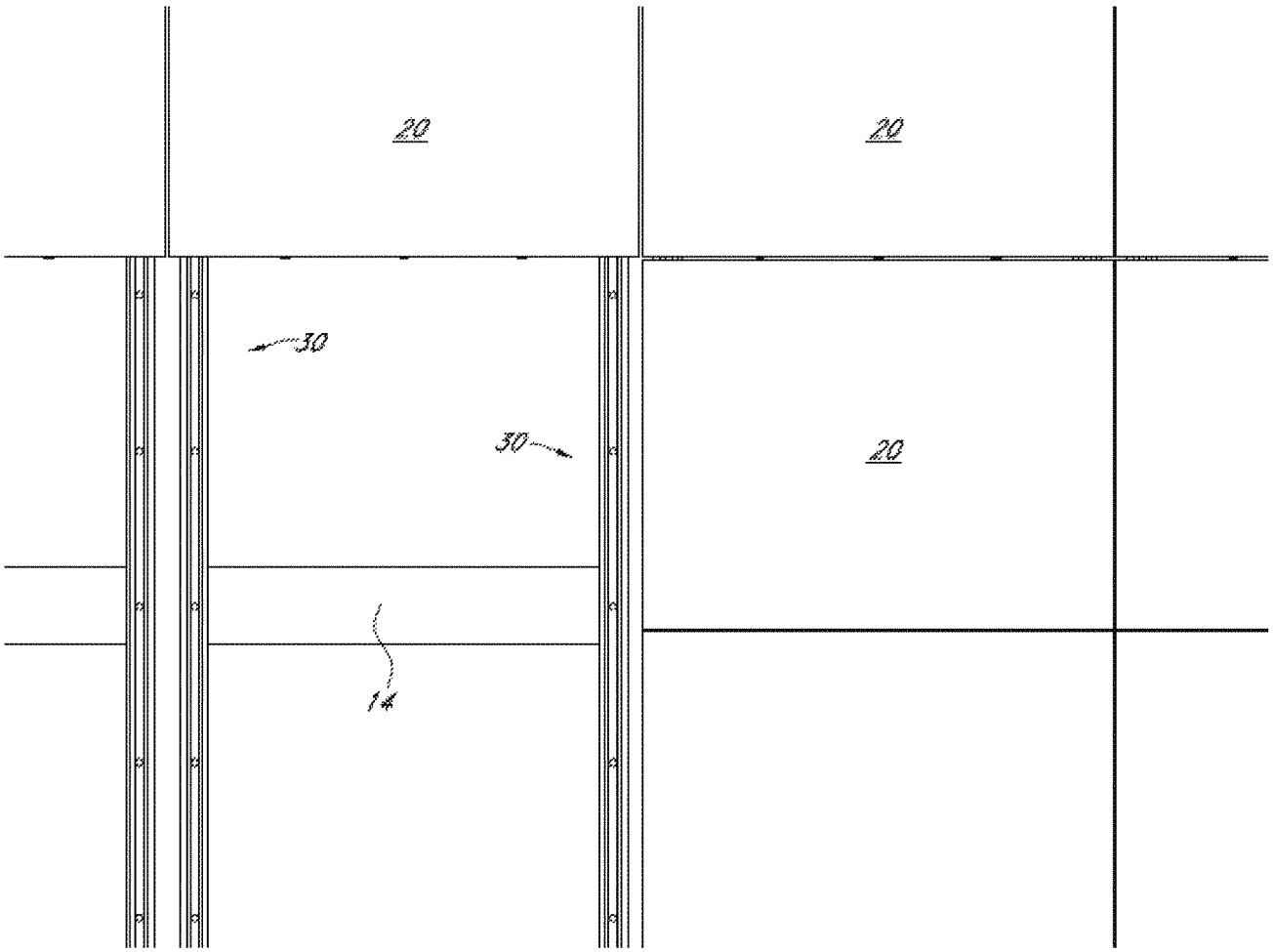
FIG. 4 is a top view of the illustrative embodiment of support structures and tiles shown in FIG. 3.
Figure 5:
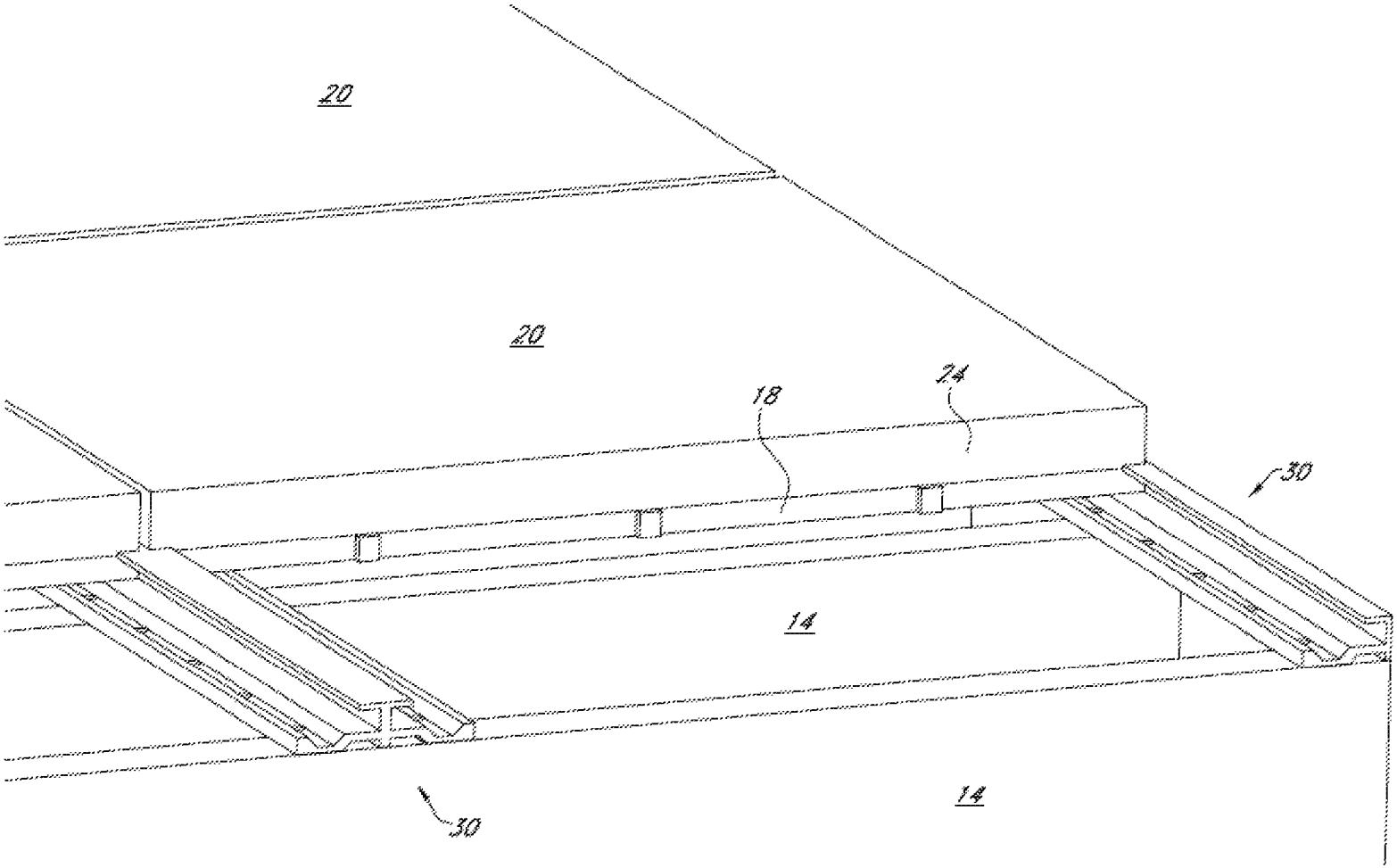
FIG. 5 is a detailed perspective view of a portion of the embodiments shown in FIGS. 3 and 4.
Figure 6:
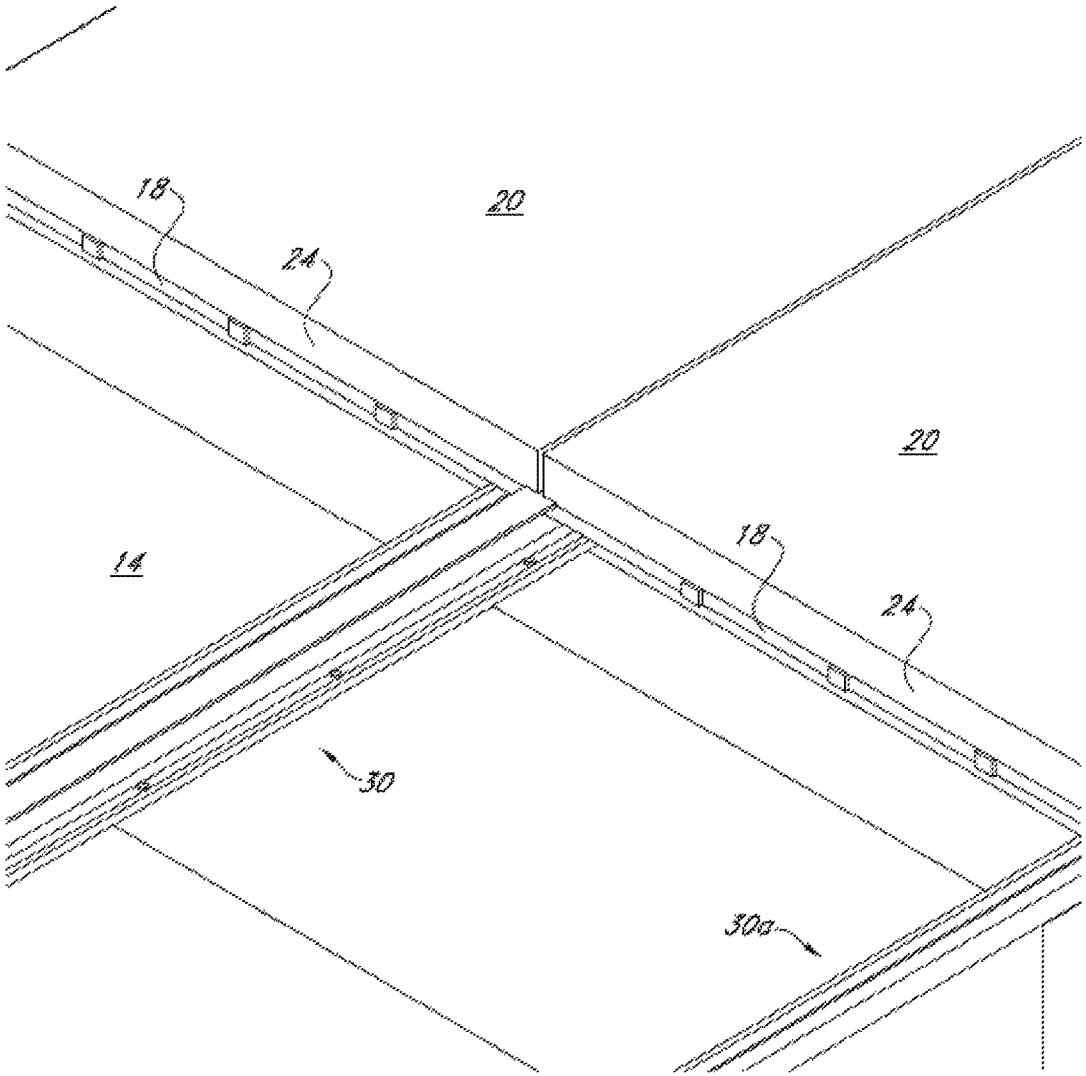
FIG. 6 is another detailed perspective view of a portion of the embodiments shown in FIGS. 3 and 4.

A perspective view of the joist 14 and support structure 30 grid after a plurality of tiles 20 have been engaged with the support structures 30 is shown in FIG. 3. A top view is shown in FIG. 4, and FIGS. 5 and 6 provide two detailed perspective views. Those of ordinary skill in the art will recognize the arrangement in FIG. 3 as one embodiment of a deck 12 that may be constructed according to the present disclosure. Although the tiles 20 pictured in FIG. 3 are configured as rectangles, the scope of the present disclosure is not so limited. In an embodiment not pictured herein, the shape of the tiles 20 is square. In still another embodiment not pictured herein, the shape of the tiles 20 is a parallelogram, and in still another embodiment the shape of the tiles 20 is a rhombus. Additionally, in certain embodiments of a deck 12 constructed using the tile and support structure 10 disclosed herein, certain tiles 20 at the edges and/or corners of the deck 12 may be irregularly shaped, and may have more than four sides or fewer than four sides without limitation, and which will depend at least upon the configuration of the deck 12.

Figure 7:
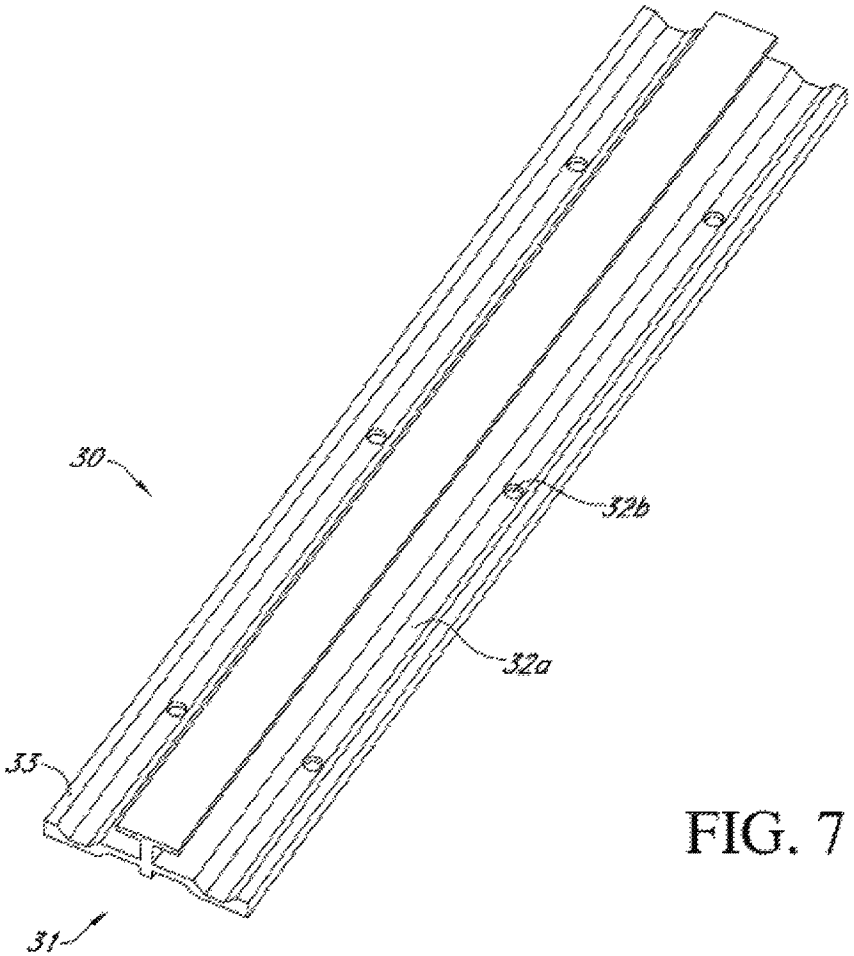
FIG. 7 is a perspective view of the illustrative embodiment of a support structure shown in FIGS. 2-6.
Figure 8:
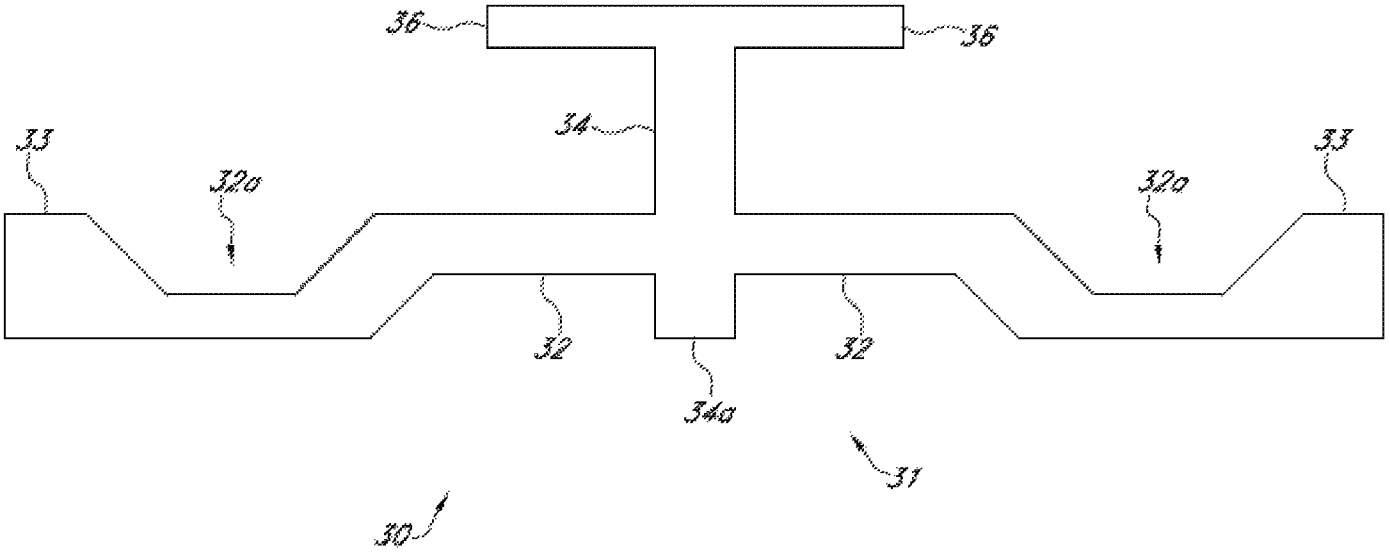
FIG. 8 is a cross-sectional view of the illustrative embodiment of a support structure shown in FIGS. 2-7.

A perspective view of an illustrative embodiment of a support structure 30 according to the present disclosure is shown in FIG. 7, and a cross-sectional view thereof is shown in FIG. 8. The support structure 30 may include a base 31 having a first and second flange 32 extending outward from a generally vertical centerline of the support structure 30. Each flange 32 may be formed with a trough **32*a* therein, and each trough 32*a* may be formed with a plurality of apertures 32*b* therein, as shown in FIG. 7. The distal edge of each trough 32*a* may be bound by a lip 33, wherein the top surface of each lip 33 may be coplanar with the top surface of each flange 32. Such a configuration may spread the force associated with a tile 20 engaged with a given support structure 30** over a larger area, as explained in further detail below.

In the illustrative embodiment, the apertures **32*b* formed in a given trough 32*a* may be spaced from one another by a distance of four inches such that a support structure 30 may be engaged with joists 14 spaced twelve or sixteen inches from adjacent joists 14 without need to modify the support structure 30. In such an embodiment, it is contemplated that multiple apertures 32*b* will not have a fastener 16 positioned therein, such that those apertures 32*b* may serve as an egress point for water and/or other liquid and/or precipitation in the trough 32***a*, and the trough 32*a* may serve as a fluid conduit (e.g., gutter) for water and/or other precipitation and/or liquids. However, the spacing of the apertures 32*b* in no way limits the scope of the present disclosure. Additionally, the apertures 32*b* may be tapered such that the head of a fastener 14 configured as a screw may seat within the aperture 32*b*, and such that in certain embodiments the head of a fastener 14 may be flush with the bottom of the trough 32*a*, and/or such that the head of a fastener 14 may be positioned below the upper surface of the flange 32. However, other embodiments of the apertures 32*b* may be differently configured without limitation.

A spine 34 may extend upward from the base 31 along the vertical centerline of the support structure 30. At the top distal end of the spine 34, two corresponding rails 36 may extend outward from the spine 34 in a generally horizontal dimension. A tip 34*a* that may be collinear with the spine 34 may extend downward from the spine 34 such that the distal end of the tip 34*a* is coplanar with the bottom surface of the base 31. Such a configuration may allow the tip 34*a* to abut a joist 14 and/or cross lathe during use. In certain embodiments, it may be advantageous to construct the support structure 30 of a metal or metallic alloy. However, the support structure 30 may be constructed of any suitable material, including but not limited to plastic, polymers, natural materials, and/or combinations thereof without limitation.

Figure 9:
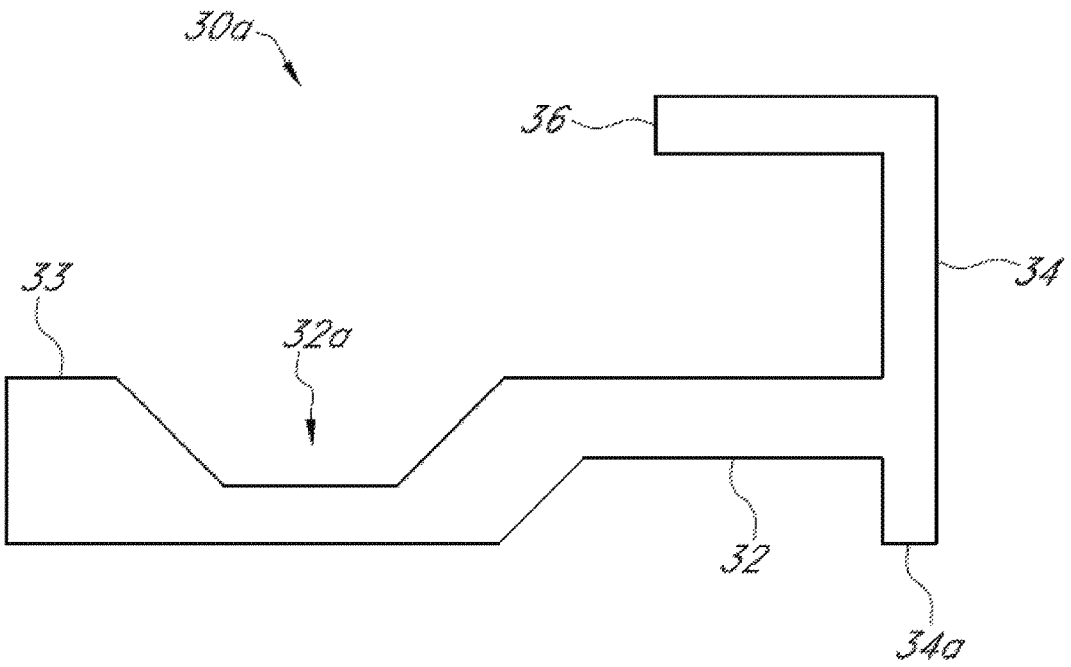
FIG. 9 is a cross-sectional view of an illustrative embodiment of an edge support structure.

A cross-sectional view of an illustrative embodiment of an edge support structure 30*a*, which may be correlative to the illustrative embodiment of a support structure shown in FIGS. 7 and 8, is shown in FIG. 9. The edge support structure 30*a* may include a base 31 having a first flange 32 extending outward therefrom. The flange 32 may be formed with a trough 32*a* therein, and the trough 32*a* may be formed with a plurality of apertures 32*b* therein. The distal edge of the trough 32*a* may be bound by a lip 33, wherein the top surface of each lip 33 may be coplanar with the top surface of the flange 32. Such a configuration may spread the force associated with a tile 20 engaged with a given edge support structure 30*a* over a larger area, as explained in further detail below.

In the illustrative embodiment, the apertures 32*b* formed in the trough 32*a* may be spaced from one another by a distance of four inches such that an edge support structure 30*a* may be engaged with joists 14 spaced twelve or sixteen inches from adjacent joists 14 without need to modify the edge support structure 30*a*. However, the spacing of the apertures 32*b* in no way limits the scope of the present disclosure. Additionally, the apertures 32*b* may be tapered such that the head of a fastener 14 configured as a screw may seat within the aperture 32*b*, and such that in certain embodiments the head of a fastener 14 may be flush with the bottom of the trough 32*a*. However, other embodiments of the apertures 32*b* may be differently configured without limitation.

A spine 34 may extend upward from the base 31 in a generally vertical dimension. At the top distal end of the spine 34, a rail 36 may extend outward from the spine 34 in a generally horizontal dimension, wherein the rail 36 may be generally parallel with respect to the flange 32 and generally perpendicular with respect to the spine 34. A tip 34*a* that may be collinear with the spine 34 may extend downward from the spine 34 such that the distal end of the tip 34*a* is coplanar with the bottom surface of the base 31. Such a configuration may allow the tip 34*a* to abut a joist 14 and/or cross lathe during use.

The various relative dimensions of the components of the support structure 30 may be infinitely varied depending on the specific application of the support structure 30. Several illustrative embodiments of different support structures 30 according to the present disclosure and dimensions of the components of the support structure 30 are shown in FIGS. 11A-11E. However, these embodiments and dimensions are not meant to be limiting in any sense, but rather are provided to show how the various dimensions of the support structure 30 may be manipulated without departing from the spirit and scope of the present disclosure.

Figure 10:
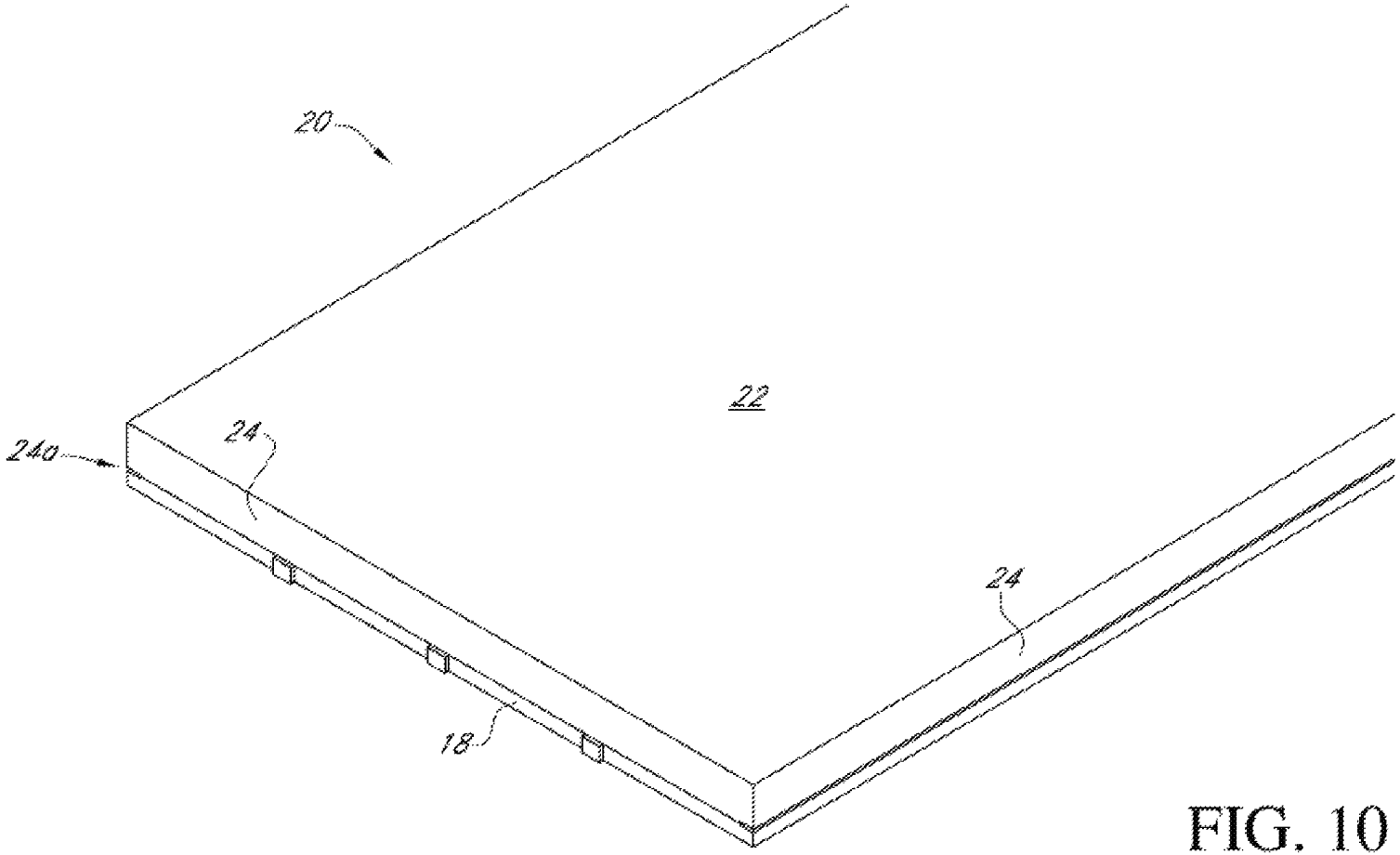
FIG. 10 is a perspective view of an illustrative embodiment of a tile that may be used with various embodiments of a support structure.
Figure 11A:
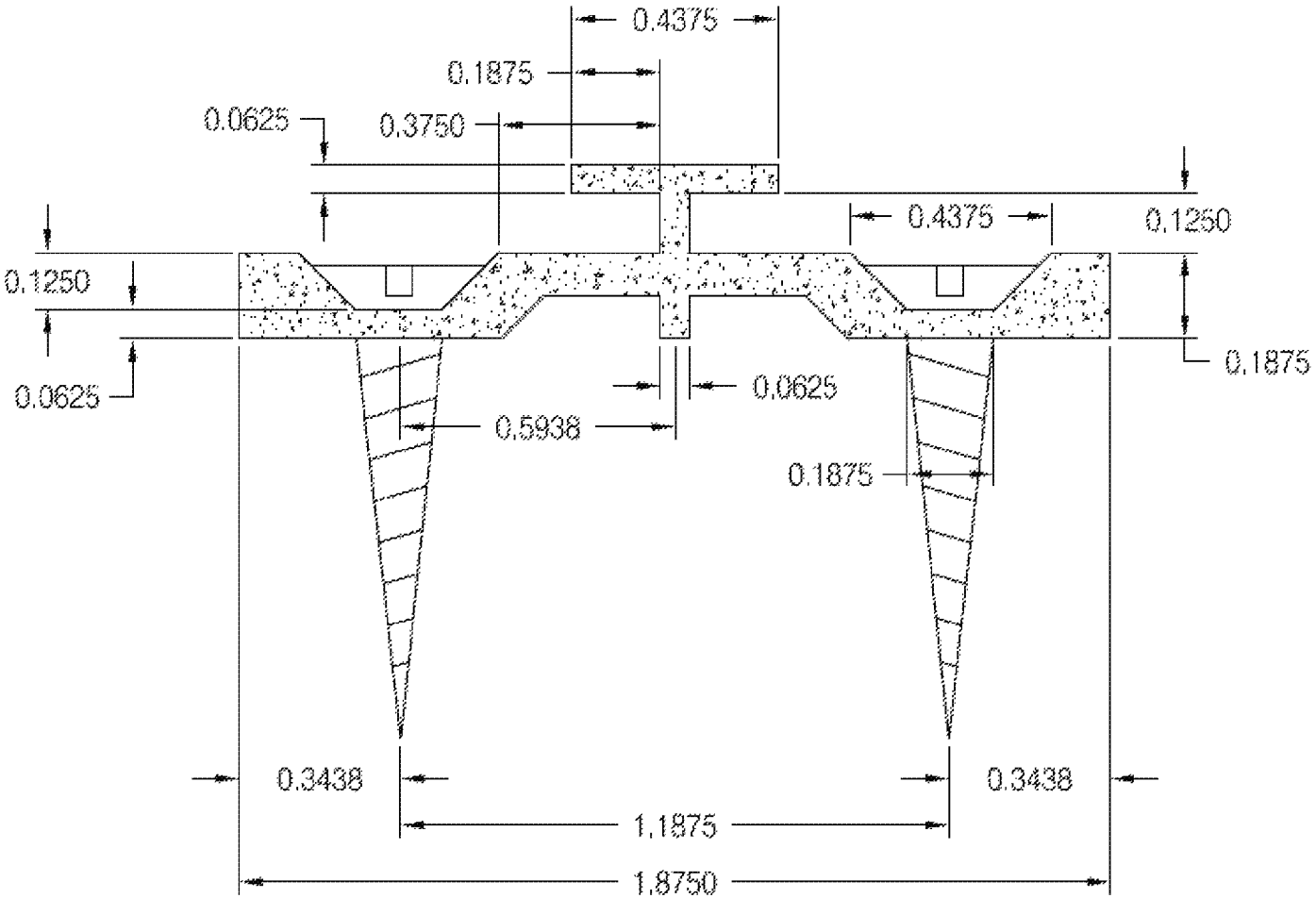
FIG. 11A is a cross-sectional view of another embodiment of a support structure showing dimensions of various elements thereof.
Figure 11B:
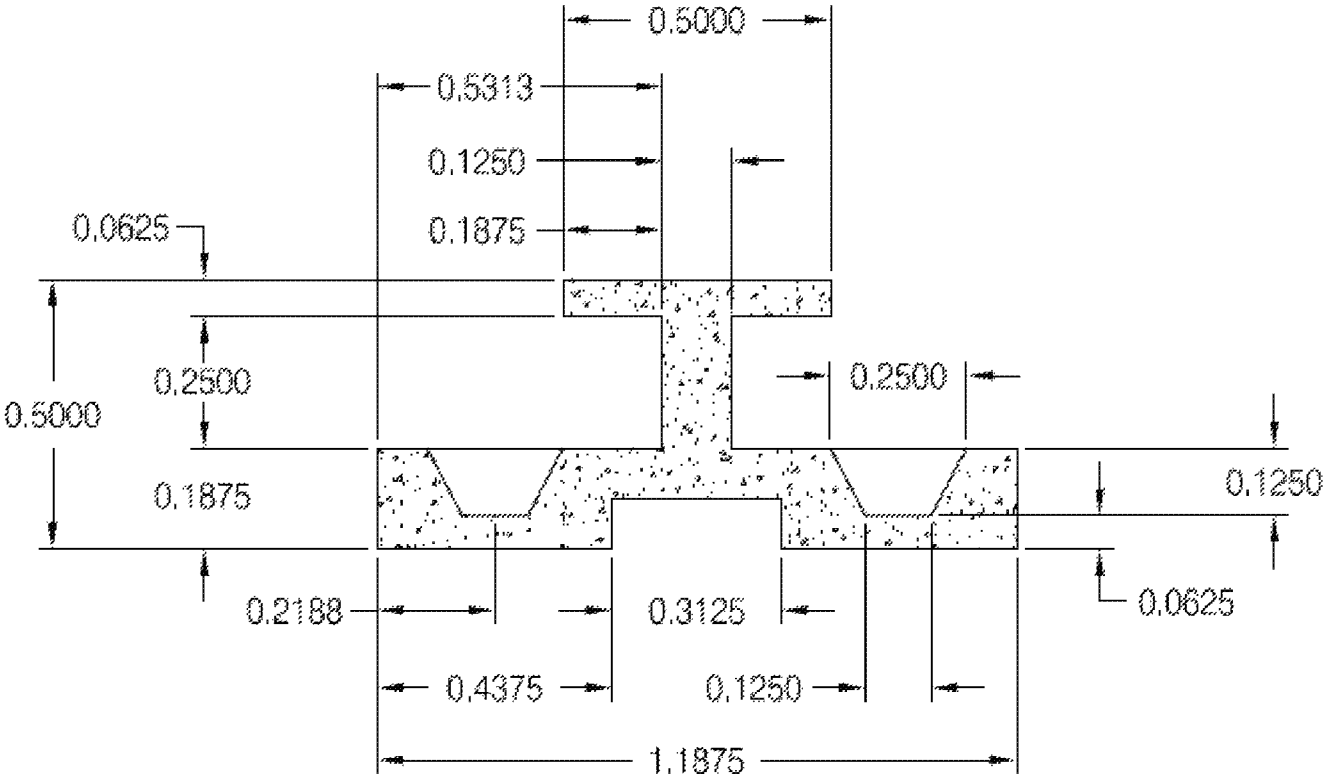
FIG. 11B is a cross-sectional view of another embodiment of a support structure showing dimensions of various elements thereof.
Figure 11C:
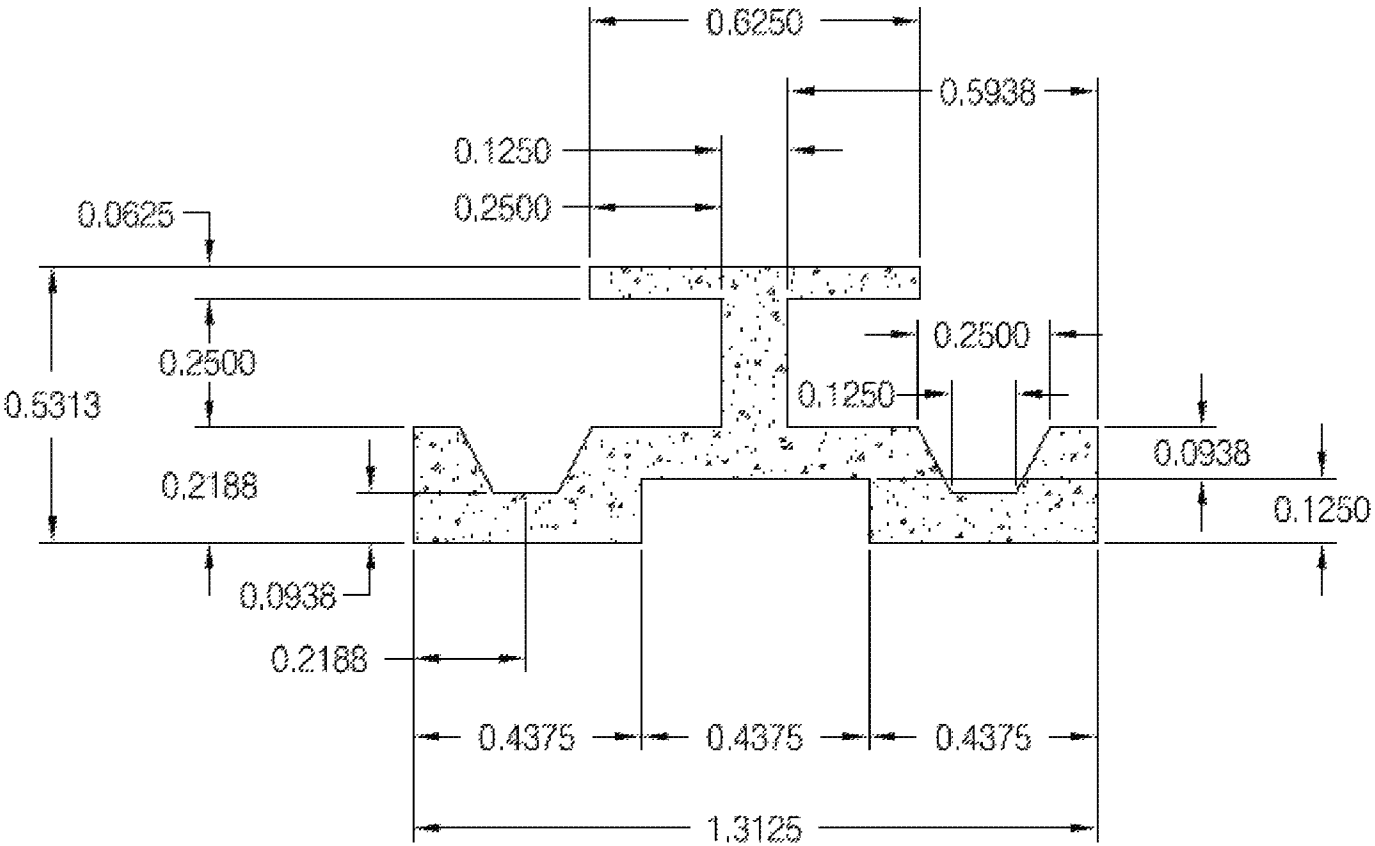
FIG. 11C is a cross-sectional view of another embodiment of a support structure showing dimensions of various elements thereof.
Figure 11D:
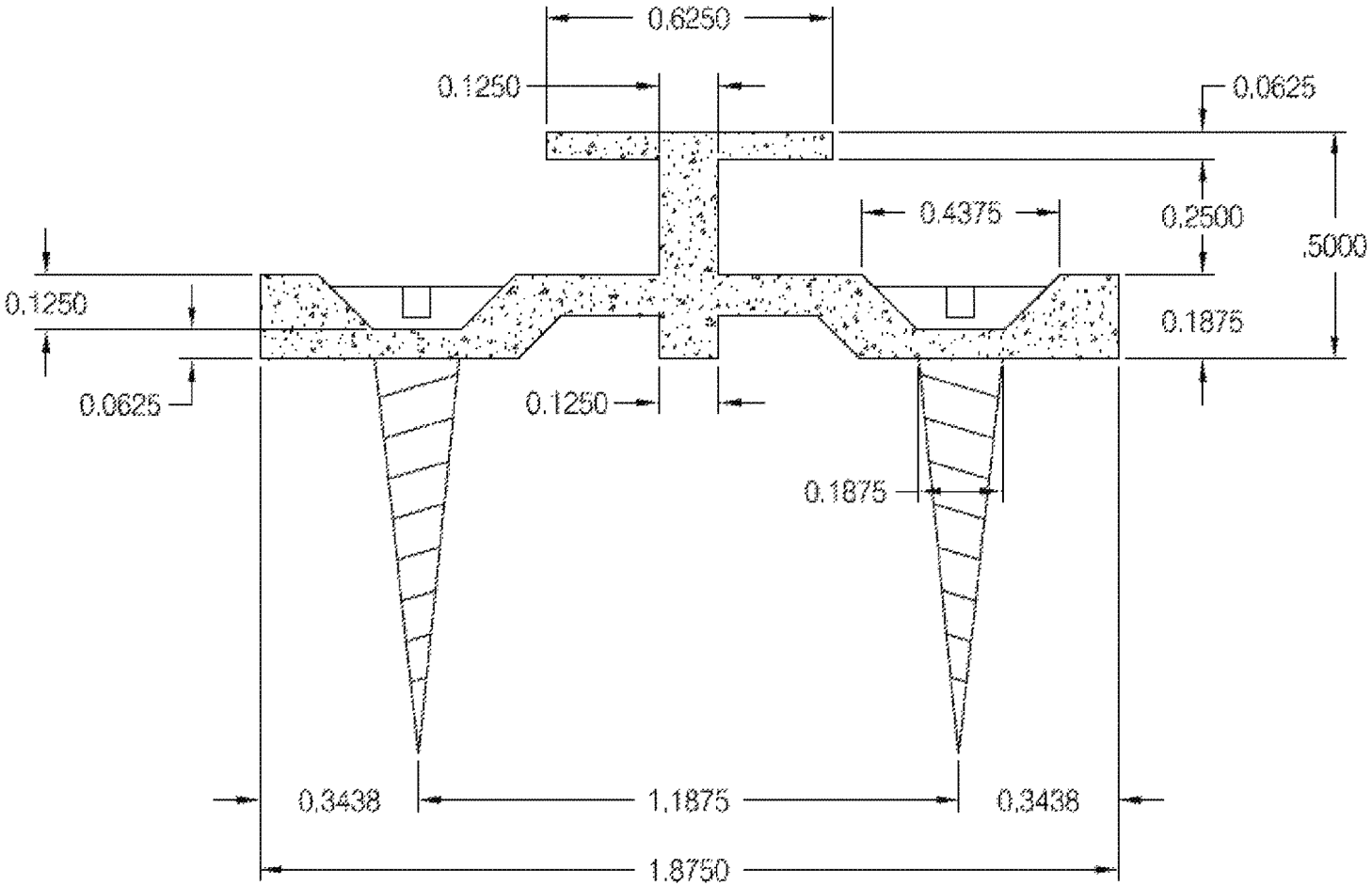
FIG. 11D is a cross-sectional view of another embodiment of a support structure showing dimensions of various elements thereof.
Figure 11E:
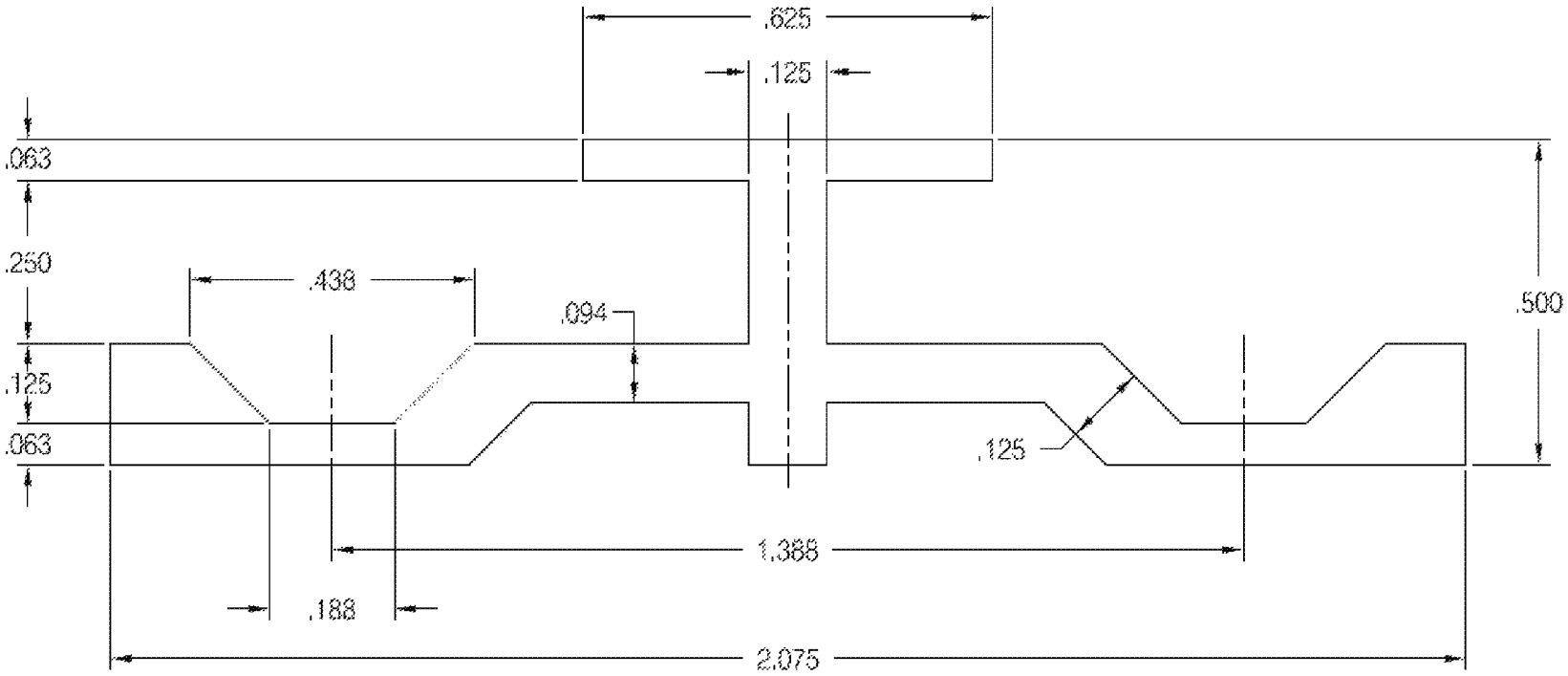
FIG. 11E is a cross-sectional view of another embodiment of a support structure showing dimensions of various elements thereof.

An illustrative embodiment of a tile 20 that may be engaged with the illustrative embodiment of a support structure 30 is shown in FIG. 10. The illustrative embodiment of a tile 20 may be generally rectangular in shape (as shown in FIG. 3), such that two rectangular-shaped faces 22 are spaced from one another by the height of an edge 24 of the tile 20. In one embodiment, the height of an edge 24 may be 20 millimeters, and in another embodiment the height thereof may be 30 millimeters. However, as previously mentioned, the scope of the present disclosure is not limited by the specific shape of the tile 20. The bottom face 22 may be engaged with a substrate 18, which may be configured as a synthetic (e.g., fiberglass, plastic, etc.) sheet having a periphery equal to or approximately equal to that of the tile 20. In one embodiment, the thickness of a substrate may be ¼ of an inch, but the specific dimensions of the substrate 18, if used for that embodiment of a tile 20, is in no way limiting to the scope of the present disclosure. If a substrate 18 is used, it may be engaged with the tile 20 using any suitable structure and/or method suitable for the particular application of the tile 20, including but not limited to chemical adhesives, mechanical fasteners, and/or combinations thereof. The scope of the present disclosure is in no way limited by whether a substrate 18 is engaged with a tile 20.

Figure 12A:
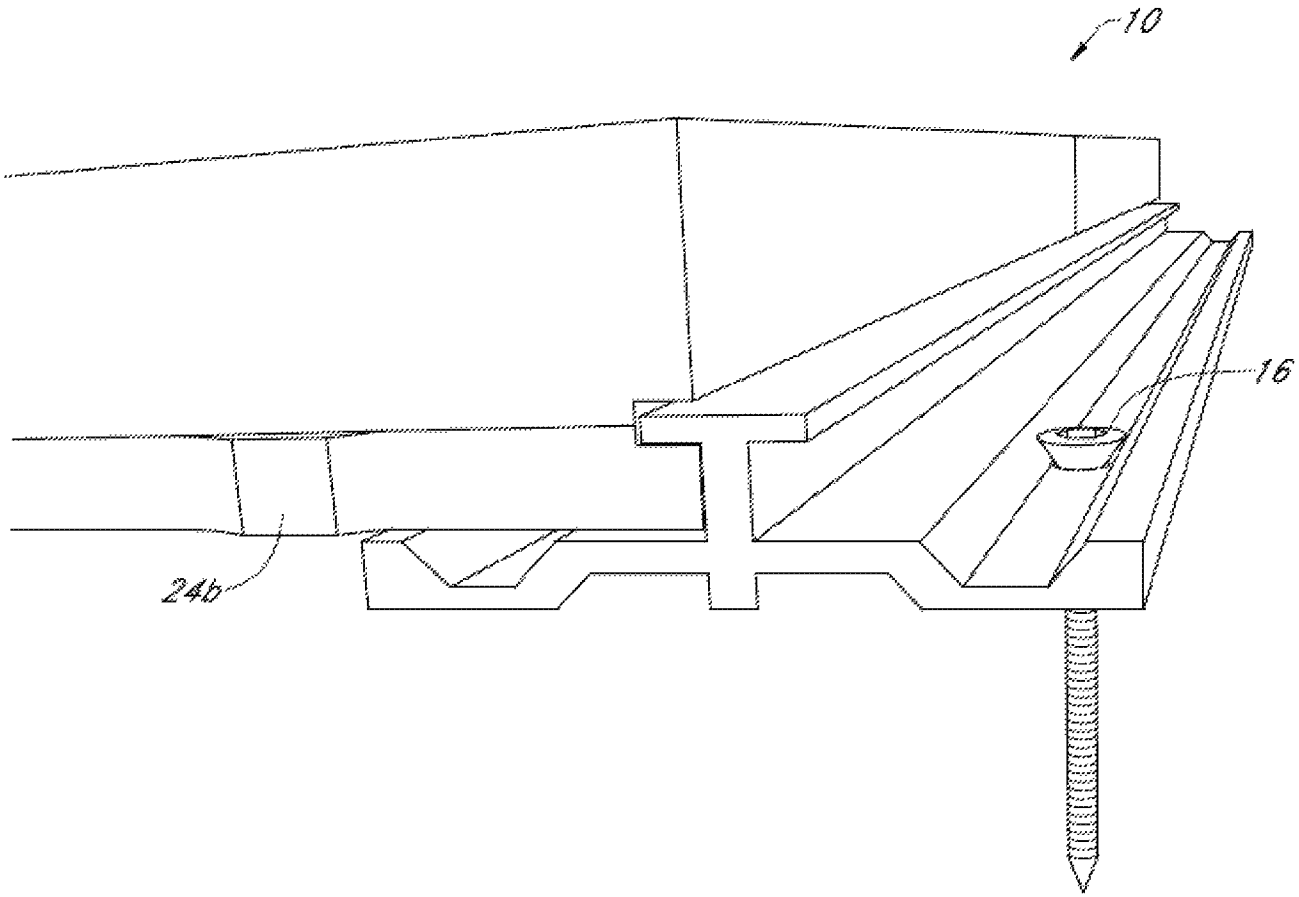
FIG. 12A is a detailed perspective view of an illustrative embodiment of a tile engaged with an illustrative embodiment of a support structure.
Figure 12B:
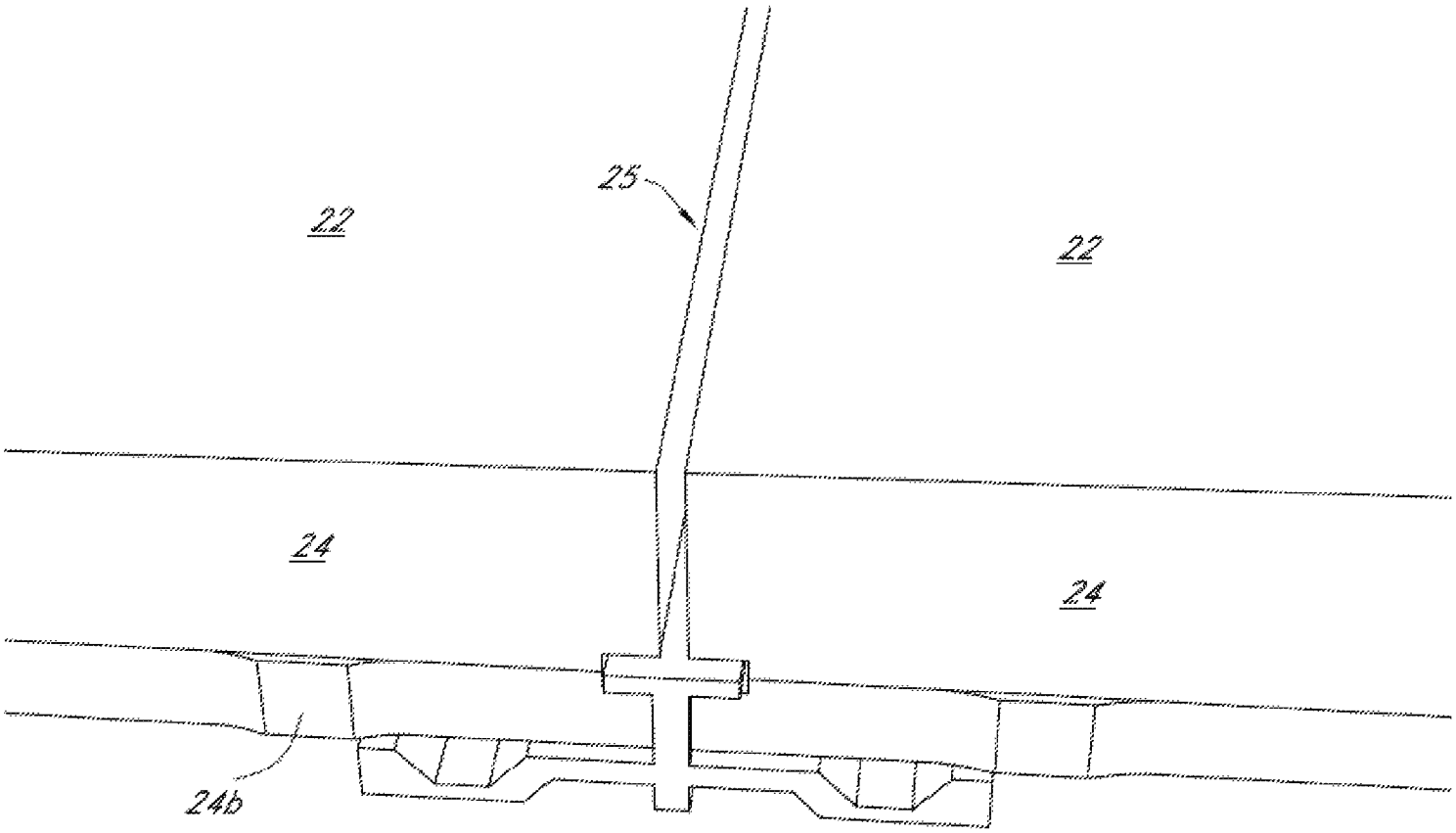
FIG. 12B is a detailed perspective view of two illustrative embodiments of tiles engaged with an illustrative embodiment of a support structure.

Opposite edges 24 of a tile 20 may be formed with a groove 24*a* therein, as shown in FIGS. 10, 12A, and 12B. The groove 24*a* may be formed in the edge 24 of the tile 20, in a portion of the edge 24 of the tile 20, in a portion of a surface of a substrate 18 (if present), and/or a combination of a portion of the tile 20 and a portion of the substrate 18. The groove 24*a* may be configured such that it cooperates with the rail 36 at the top distal end of the spine 34, and such that the bottom face 22 of the tile 20 (or bottom surface of the substrate 18, if present for that embodiment of a tile 20) rests upon the top surface of the flange 32 and lip 33, as clearly shown in FIGS. 12A and 12B. Accordingly, one tile 20 may be engaged on opposing edges 24 of the tile 20 with adjacent support structures 30. In this manner, the tile 20 may slide with respect to the support structures 30 along the lengths of the support structures 30. Such a configuration allows adjacent tiles 20 between corresponding support structures 30 to be slid into place from an open end of the support structures 30 until the final tile 20 is positioned. Simultaneously, this configuration may secure the relative position of the tile 20 with respect to the support structures 30 in all other dimensions (e.g., a vertical dimension and a horizontal dimension perpendicular with respect to the length of the support structures 30). It is contemplated that the dimensions of the groove 24*a* may be selected such that a common blade and/or tool may be used to form the required groove 24*a* in a given edge 24. It is also contemplated that in certain embodiments of a tile and support structure 10, a predetermined amount of space may exist between the surfaces of a groove 24*a* and the surfaces of a rail 36, between the edge 24 and the spine 34, and between the bottom face 22 and flange 32 such that water and/or other liquids and/or other precipitation may flow via gravity between the groove 24*a* and the rail 36, between the edge 24 and spine 34, and/or between the bottom face 22 and flange 32.

Referring now specifically to FIG. 12B, the grooves 24*a* and the support structure 30 may be configured such that a clearance 25 exists between adjacent tiles 20 on opposing sides of a support structure 30. In the illustrative embodiment, the width of the clearance 25 may be ⅛ of an inch. The various dimensions of the tile (e.g., edge 24, groove 24*a*, etc.) and support structure 30 (e.g., height and width of spine 34, length of rail 36, etc.) may be varied to change the width and depth of the clearance 25, and the optimal width and depth of the clearance 25 may vary from one application of the tile and support structure 10 to the next. Accordingly, the scope of the present disclosure is in no way limited by the specific dimensions and/or configuration of the clearance 25.

Figure 12C:
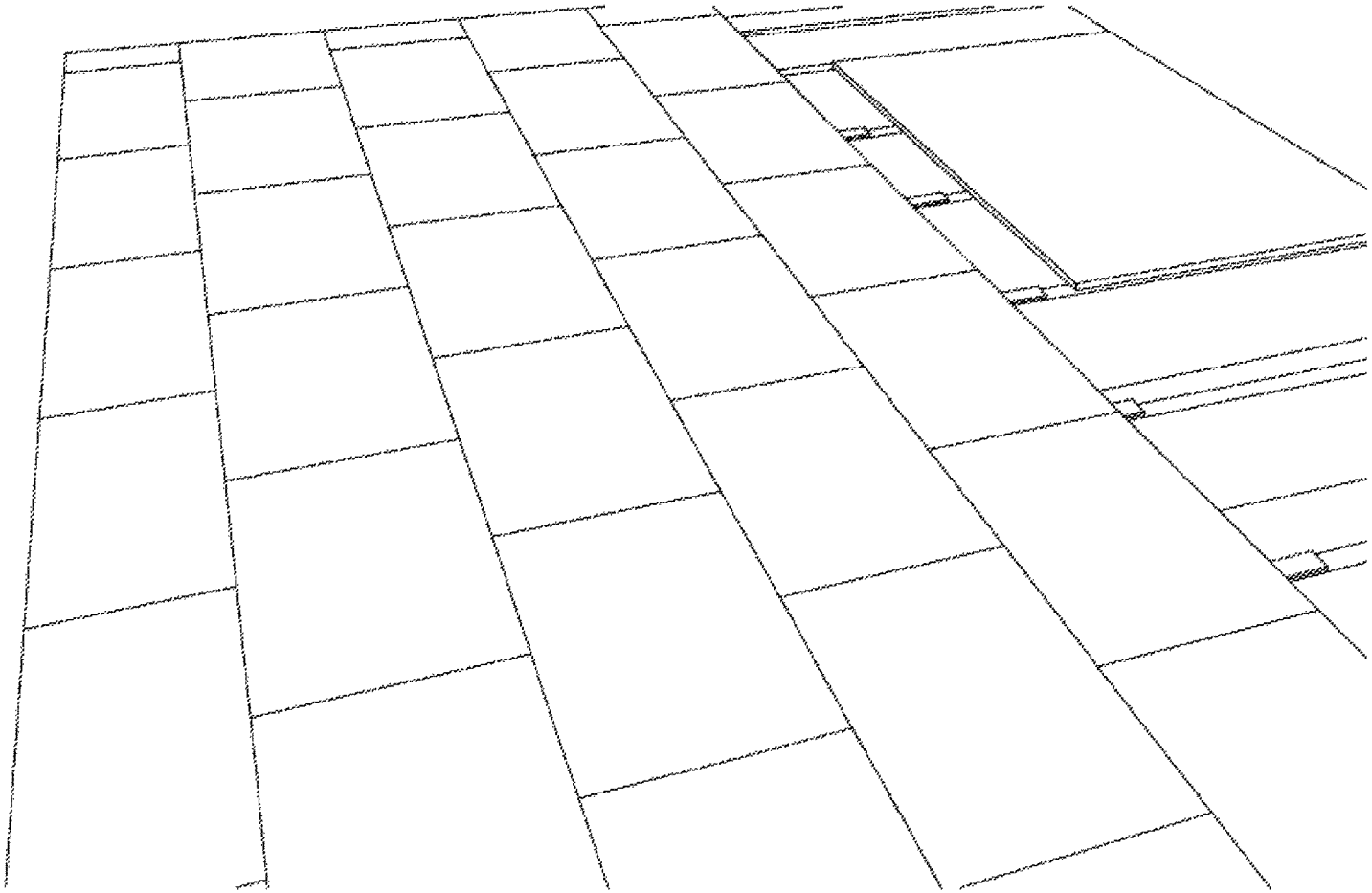
FIG. 12C is a perspective view of a portion of a deck constructed according to the present disclosure.

Still referring to FIGS. 12A and 12B, the tile 20 may be formed with a protrusion 24*b* on an edge 24 thereof not configured with a groove 24*a*. The protrusions 24*b* may be configured such that when protrusions 24*a* of adjacent tiles 20 abut one another, the space between the edges 24 thereof is equal or approximately equal to the width of the clearance 25 between edges 24 of adjacent tiles 20 having grooves 24*a* formed therein. An illustrative example of a portion of a deck 12 employing a tile and support structure 10 so configured is shown in FIG. 12C. However, in other embodiments not pictured herein, the space between adjacent tiles 20 along edges 24 thereof having protrusions 24*b* may be different that the width of the clearance 25 without limitation. It is contemplated that the clearance 25 and/or space between the edges 24 of adjacent tiles 20 having protrusions 24*b* formed therein may facilitate drainage of water and/or other liquids from the top face 22 of the tile 20 and/or an area adjacent thereto to and area below the tile 20, the path for which may proceed into the trough 32*a* and out through one or more apertures 32*b*. However, the specific spacing between any edge 24 of adjacent tiles 20 may vary according to the present disclosure without limitation.

It is contemplated that for certain applications of the tile and support structure 10, it may be especially advantageous to construct the tile 20 from porcelain or stone, the substrate 18 (if present) from fiberglass, and the support structure from aluminum. However, the tile and support structure 10 and various elements thereof may be constructed of any suitable material known to those skilled in the art without limitation. Accordingly, the present methods and structures may work with any tile-based product, particularly tile made of clay. As disclosed and claimed herein, a tile 20 suitable for use as a deck tile may be composed of fiber glass fiber and clay, with not less than one percent fiberglass fiber by weight may desirable for certain applications. Another tile 20 that may be suitable for certain applications according to the present disclosure may be composed of fiber glass fiber and clay, with not less than twenty five percent fiberglass fiber by weight. For certain applications, it may be advantageous for a tile 20 to have a width of approximately twelve inches, a length of approximately twenty-four inches, and a thickness of one to one and one half inches.

Illustrative Method of Use

Having described the preferred embodiments, an illustrative method of using the tile and support structure 10 will now be described. This method of use is not intended to limit the scope of the present disclosure in any way, but is instead provided for illustrative purposes only. Even though the foregoing illustrative method of use is primarily adapted for decks 12, the scope of the present disclosure is not so limited.

The tile and support structure 10 as disclosed and claimed herein may be used to build a deck 12, wherein the tread surface of the deck 12 is comprised of the top faces 22 of the tiles 20. Generally, the supporting surface for a deck 12 may be a plurality of joists 14 arranged in a parallel fashion in a manner similar to that shown in FIG. 1. However, other suitable structures and/or methods for forming a foundation and/or underlying support for a deck 12 may be used without limiting the scope of the present disclosure.

An edge support structure 30*a* may be engaged with the joists 14 adjacent one end of the joists 14 (e.g., the end of the joists 14 engaged with the building or other structure adjacent the deck 12). A support structure 30 may then be spaced from the edge support structure 30 by a predetermined amount and engaged with the joists 14 such that the position of the support structure 30 is fixed. As previously explained, a cross lathe may be positioned between the edge support structure 30*a* and the joist(s) 14 and/or between the support structure 30 and the joist(s) 14 if needed/desired.

The distance between the edge support structure 30*a* and the support structure 30 may be dependent at least upon the configuration of the tile 20 to be used with the deck 12, and more specifically at least upon the distance between edges 24 of the tile 20 having grooves 24*a* formed therein. Subsequent support structures 30 may be engaged with the joists 14. Depending at least upon the configuration of the tiles 20 to be used for the deck 12, the distance between adjacent support structures 30 may be generally uniform for all support structures 30 (e.g., for use with a deck 12 wherein most tiles 20 are generally of a similar shape), or some support structures 30 may be differently spaced with respect to adjacent support structures 30 (e.g., for use with a deck 12 wherein a certain number tiles 20 have different shapes). One end of the support structures 30 may be left accessible and another end thereof may be blocked and/or bound by another structure (which structure may include but is not limited to a wall of a building, a deck frame, joist 14 etc.).

After the desired number of support structures 30 (and/or edge support structures 30*a*) have been engaged with the joists 14, a tile 20 may be positioned between adjacent support structures 30 (and/or between an edge support structure 30*a* and a support structure 30). The tile 20 may be slid along the length of the support structures 30 from an open end thereof to the blocked and/or bound end thereof. During this step, the rails 36 of the support structure 30 may be positioned within the groove 24*a* formed in one or more edges 24 of the tile 20. Another tile 20 may be slide along the length of the same support structures 30 until the protrusions 24*b* on the edges 24 of the tiles 20 engage one another. Subsequent tiles 20 may be positioned between other support structures 30 until a majority of the deck 12 is built.

In many instances it is contemplated that tiles 20 positioned on the periphery of the deck 12 may require cutting and/or resizing due to various factors, including but not limited to the shape of the periphery of the deck 12. Accordingly, after all or a majority of the standard sized and/or shaped tiles 20 have been properly positioned, specialized tiles 20 may be slide between adjacent support structures 30. After all desired tiles 20 have been properly positioned, the open ends of the support structures 30 may be blocked and/or bound by another structure (which structure may include but is not limited to a wall of a building, a deck frame, joist 14, specialized support structure 30 with suitable aesthetics, etc.).

It is contemplated that for some embodiments it may be advantageous to use the tiles 20 to ensure that adjacent support structures 30 are properly spaced from one another. In such an embodiment, the support structures 30 may be engaged with a joist 14 only at one end of the support structures 30. As tiles 20 are positioned between the support structures 30, a user may ensure the proper position of the support structures 30 by placing a lateral force thereon such that the tiles 20 are effectively pinched between the support structures 30, at which point the support structures 30 may be engaged with the joist(s) 14 adjacent the most terminal tile 20. Those of ordinary skill in the art will appreciate that this may be done in a progressive manner. That is, as each row of tiles 20 is slid between the support structures 30, another fastener(s) 16 may be used to engage the support structure(s) 30 with the joist(s) 14.

Those of ordinary skill in the art will appreciate that at this point, the relative positions of the tiles 20, support structures 30, and joists 14 generally may fixed in three dimensions, but simultaneously incremental changes in those relative positions may be allowed via flexing, bending, and/or other allowed movement between one tile 20 and adjacent tiles 20, between a tile 20 and support structures 30 engaged with the tile, and/or between a support structure 30 and the joist(s) 14 (or other underlying structure) with which it is engaged. It is contemplated that at least the configuration of the tiles 20 may affect the amount of incremental changes in the above-referenced relative positions. It is contemplated that a configuration allowing some or all of the incremental changes listed above may prevent cracking and/or other damage to the tiles 20, which may be manufacturing of a generally rigid, inflexible material.

From the preceding detailed description, it will be apparent to those of ordinary skill in the art that the present disclosure provides many benefits over the prior art. Some of those benefits include, but are not limited to, the ability to provide a tile deck 12 without the need for grout and/or other sealer, the ability to provide a deck surface that is virtually maintenance free, the ability to provide a deck surface that mitigates and/or eliminates puddling even when the deck surface is level and/or nearly level, the ability to provide a more robust deck surface that is not affected by typical freeze/thaw cycles, and the ability to allow a certain amount of relative movement between tiles 20, tiles 20 and support structures 30, tiles 20 and joists 14, and/or tiles 20 and other structures without damaging the tiles 20.

Although the descriptions of the illustrative embodiments have been quite specific, it is contemplated that various modifications could be made without deviating from the spirit and scope of the present disclosure. Accordingly, the scope of the present disclosure is not limited by the description of the illustrative embodiments.

The number, configuration, dimensions, geometries, and/or relative locations of the various elements of the tile 20 and/or support structure 30 will vary from one embodiment of the tile and support structure 10 to the next, as will the optimal configuration thereof. Accordingly, the tile and support structure 10 as disclosed and claimed herein is in no way limited by the specific constraints of those elements.

In the foregoing detailed description, various features are grouped together in a single embodiment for purposes of streamlining the disclosure. This method of disclosure is not to be interpreted as reflecting an intention that the present disclosure requires more features than are expressly recited in each claim. Rather, as the following claims reflect, inventive aspects lie in less than all features of a single foregoing disclosed embodiment. Thus, the following claims are hereby incorporated into this detailed description, with each claim standing on its own as a separate embodiment of the invention.

Having described the preferred embodiments, other features, advantages, and/or efficiencies of the present disclosure will undoubtedly occur to those versed in the art, as will numerous modifications and alterations of the disclosed embodiments and methods, all of which may be achieved without departing from the spirit and scope of the present disclosure as disclosed and claimed herein. It should be noted that the present disclosure is not limited to the specific embodiments pictured and described herein, but are intended to apply to all similar apparatuses and/or methods for providing the various benefits of those elements, which benefits are explicitly and/or inherently disclosed herein. Modifications and alterations from the described embodiments will occur to those skilled in the art without departure from the spirit and scope of the present disclosure.

It is understood that the tile and support structure 10 as disclosed herein extends to all alternative combinations of one or more of the individual features mentioned, evident from the text and/or drawings, and/or inherently disclosed. All of these different combinations constitute various alternative aspects of the tile and support structure 10. The embodiments described herein explain the best modes known for practicing the tile and support structure 10 and will enable others skilled in the art to utilize the same. The claims are to be construed to include alternative embodiments to the extent permitted by the prior art. An Appendix, which is incorporated by reference herein and made a part of this disclosure, provides alternative configurations of various elements of the tile and support structure 10, additional details, fabrication prints, and designs for steps and/or varying elevation surfaces.

What is claimed is:

1. A tile and support structure comprising:

a. a tile having a length, a width, and a thickness, said tile comprising:
   - i. a first face, wherein said first face is configured to be generally facing upward during use;
   - ii. a second face, wherein said second face is opposite said first face, wherein said first and second faces are separated by said thickness of said tile, and wherein a surface area of said first and second faces is defined by said length and said width of said tile;
   - iii. a first, second, third, and fourth edge defining a periphery of said tile;
   - iv. a groove formed in one of said first, second, third, or fourth edges;

b. a support structure comprising:
   - i. a base having a first flange and a second flange, wherein said first and second flanges are opposed to one another, wherein said first and second flanges are each formed with a plurality of apertures formed therein along a length of each said flange, wherein a distal end of each said flange terminates at a lip extending upward from each said flange, and wherein said lip is formed with a flat top surface and a flat bottom surface;
   - ii. a spine engaged with said base, wherein said spine extends upward from a center of said base, and wherein said spine is generally perpendicular with respect to said base;

iii. a first rail extending from a terminal end of said spine, wherein said first rail is generally perpendicular with respect to said spine;

iv. a second rail extending from said terminal end of said spine, wherein said second rail is generally perpendicular with respect to said spine, wherein said support structure is generally symmetrical about a plane perpendicularly oriented with respect to said first and second rails and bisecting said spine, and wherein said first and second rails are configured to engage said groove so as to secure and position said tile with respect to said support structure in a dimension parallel with respect to said thickness of said tile and simultaneously allow said tile to move with respect to said support structure in a dimension parallel to said length of said tile.

2. The tile and support structure according to claim 1 wherein said tile is further defined as a square tile.

3. The tile and support structure according to claim 1 wherein said tile is further defined as being generally rectangular.

4. The tile and support structure according to claim 3 wherein said tile is further defined as being constructed of porcelain.

5. The tile and support structure according to claim 4 said support structure is further defined as being configured for engagement with a joist.

6. The tile and support structure according to claim 5 wherein said tile further comprises a substrate engaged with said second face, wherein a thickness of said substrate is less than half said thickness of said tile.

7. The tile and support structure according to claim 5 wherein said first and third edges of said tile are further defined as being longer than said second and fourth edges of said tile, and wherein said groove is further defined as being positioned in said first edge.

8. The tile and support structure according to claim 7 further comprising a second groove formed in said third edge.

9. The tile and support structure according to claim 5 further comprising a second support structure oriented parallel with respect to said support structure, said second support structure comprising:

a. a base having a first flange and a second flange, wherein said first and second flanges are opposed to one another, wherein said first and second flanges are each formed with a plurality of apertures formed therein along a length of each said flange;

b. a spine engaged with said base, wherein said spine extends upward from a center of said base, and wherein said spine is generally perpendicular with respect to said base;

c. a first rail extending from a terminal end of said spine, wherein said first rail is generally perpendicular with respect to said spine;

d. a second rail extending from said terminal end of said spine, wherein said second rail is generally perpendicular with respect to said spine, wherein said second support structure is generally symmetrical about a plane perpendicularly oriented with respect to said first and second rails and bisecting said spine, and wherein said first rail is configured to engage said second groove so as to secure and position said tile with respect to said second support structure in a dimension parallel with respect to said thickness of said tile and simultaneously allow said tile to move with respect to said second support structure in a dimension parallel to said length of said tile.

10. A method of building a deck, said method comprising:

a. securing a first support structure to a first and a second joists, wherein a length of said first support structure is perpendicular to said first and second joists, wherein said first and second joists are parallel with respect to one another and separated from one another by a first distance;

b. and wherein said first support structure comprises:

i. a base having a first flange and a second flange, wherein said first and second flanges are opposed to one another, wherein a distal end of each said flange terminates at a lip extending upward from each said flange, and wherein said lip is formed with a flat top surface and a flat bottom surface;

ii. a spine engaged with said base, wherein said spine extends upward from a center of said base, and wherein said spine is generally perpendicular with respect to said base;

iii. a first rail extending from a terminal end of said spine, wherein said first rail is generally perpendicular with respect to said spine;

iv. a second rail extending from said terminal end of said spine, wherein said second rail is generally perpendicular with respect to said spine, and wherein said support structure is generally symmetrical about a plane perpendicularly oriented with respect to said first and second rails and bisecting said spine;

c. securing a second support structure to said first and second joists, wherein a length of said second support structure is perpendicular to said first and second joists, and wherein said second support structure comprises:

i. a base having a first flange and a second flange, wherein said first and second flanges are opposed to one another;

ii. a spine engaged with said base, wherein said spine extends upward from a center of said base, and wherein said spine is generally perpendicular with respect to said base;

iii. a first rail extending from a terminal end of said spine, wherein said first rail is generally perpendicular with respect to said spine;

iv. a second rail extending from said terminal end of said spine, wherein said second rail is generally perpendicular with respect to said spine, and wherein said support structure is generally symmetrical about a plane perpendicularly oriented with respect to said first and second rails and bisecting said spine;

d. sliding a first tile between said first and second support structures, wherein said tile has a length, a width, and a thickness, said first tile further comprising:

i. a first face, wherein said first face is configured to be generally facing upward during use;

ii. a second face, wherein said second face is opposite said first face, wherein said first and second faces are separated by said thickness of said first tile, and wherein a surface area of said first and second faces is defined by said length and said width of said first tile;

iii. a first, second, third, and fourth edge defining a periphery of said first tile;

iv. a first groove formed in one of said first edge;

v. a second groove formed in one of said third edge, wherein said first and third edges are parallel to one another;

e. securing a position of said first tile with respect to said first and second support structures in a generally horizontal dimension parallel with respect to said first and second joists via an engagement of said first and second rails with said first and second grooves in said first tile; and, f. securing a position of said first tile with respect to said first and second support structures in a generally vertical dimension perpendicular with respect to said first and second joists via an engagement of said first and second rails with said first and second grooves in said first rectangular tile.

11. The method according to claim 10 further comprising the step of allowing said first rectangular tile to slide along said length of said first and second support structures.

12. The method according to claim 10 further comprising:

a. sliding a second rectangular tile between said first and second support structures, wherein said second tile has a length, a width, and a thickness, said second rectangular tile comprising:

i. a first rectangular face, wherein said first rectangular face is configured to be generally facing upward during use;

ii. a second rectangular face, wherein said second rectangular face is opposite said first rectangular face, wherein said first and second rectangular faces are separated by said thickness of said second rectangular tile, and wherein a surface area of said first and second rectangular faces is defined by said length and said width of said second rectangular tile;

iii. a first, second, third, and fourth edge defining a periphery of said second rectangular tile;

iv. a first groove formed in one of said first edge; and, v. a second groove formed in one of said third edge, wherein said first and third edges are parallel to one another;

b. securing a position of said second rectangular tile with respect to said first and second support structures in a generally horizontal dimension parallel with respect to said first and second joists via an engagement of said first and second rails with said first and second grooves in said second tile; and c. securing a position of said second tile with respect to said first and second support structures in a generally vertical dimension perpendicular with respect to said first and second joists via an engagement of said first and second rails with said first and second grooves in said second tile.

13. The method according to claim 12 further comprising the step of allowing said second tile to slide along said length of said first and second support structures.

14. The method according to claim 13 further comprising the step of allowing said first and second joists to flex.

15. The method according to claim 14 further comprising the step of allowing water to drain in a generally downward direction along said first support structure through a plurality of apertures positioned therein.

16. The method according to claim 15 wherein said rectangular tile is further defined as having a protrusion on said second edge and a second protrusion formed on said fourth edge.

17. The method according to claim 16 wherein said second tile is further defined as having a protrusion on said second edge and a second protrusion formed on said fourth edge.

18. The method according to claim 17 further comprising the step of securing a third support structure to said first and second joists, wherein a length of said third support structure is perpendicular to said first and second joists, and wherein said third support structure comprises:

a. a base having a first flange and a second flange, wherein said first and second flanges are opposed to one another, wherein said first and second flanges are each formed with a plurality of apertures positioned therein;

b. a spine engaged with said base, wherein said spine extends upward from a center of said base, and wherein said spine is generally perpendicular with respect to said base;

c. a first rail extending from a terminal end of said spine, wherein said first rail is generally perpendicular with respect to said spine; and, d. a second rail extending from said terminal end of said spine, wherein said second rail is generally perpendicular with respect to said spine, and wherein said support structure is generally symmetrical about a plane perpendicularly oriented with respect to said first and second rails and bisecting said spine.

19. The method according to claim 10 further comprising:

a. sliding a third tile between said second and third support structures, wherein said third tile has a length, a width, and a thickness, said second tile comprising:

i. a first face, wherein said first face is configured to be generally facing upward during use;

ii. a second face, wherein said second face is opposite said first face, wherein said first and second faces are separated by said thickness of said third tile, and wherein a surface area of said first and second faces is defined by said length and said width of said third tile;

iii. a first, second, third, and fourth edge defining a periphery of said third tile;

iv. a first groove formed in one of said first edge; and, v. a second groove formed in one of said third edge, wherein said first and third edges are parallel to one another;

b. securing a position of said third tile with respect to said second and third support structures in a generally horizontal dimension parallel with respect to said first and second joists via an engagement of said first and second rails with said first and second grooves in said third tile; and, c. securing a position of said third tile with respect to said first and second support structures in a generally vertical dimension perpendicular with respect to said first and second joists via an engagement of said first and second rails with said first and second grooves in said third tile.

20. The method according to claim 19 wherein said first, second, and third tiles and said first, second, and third support structures are configured such that a distance between said first and second tiles along said second edge of said first tile and said fourth edge of said second tile is approximately equal to a distance between said first and third tiles along said third edge of said first tile and said first edge of said third tile.

* * * * *